US009384916B1

(12) United States Patent
Matsuoka et al.

(10) Patent No.: US 9,384,916 B1
(45) Date of Patent: Jul. 5, 2016

(54) KEYCAP WITH MULTI-CHARACTER DISPLAY

(71) Applicant: GOOGLE INC., Mountain View, CA (US)

(72) Inventors: Yoshimichi Matsuoka, Cupertino, CA (US); Jeffrey Hayashida, San Francisco, CA (US)

(73) Assignee: GOOGLE INC., Mountain View, CA (US)

( * ) Notice: Subject to any disclaimer, the term of this patent is extended or adjusted under 35 U.S.C. 154(b) by 226 days.

(21) Appl. No.: 14/052,487

(22) Filed: Oct. 11, 2013

(51) Int. Cl.
*H01H 13/02* (2006.01)
*G06C 7/02* (2006.01)

(52) U.S. Cl.
CPC ..... *H01H 13/023* (2013.01); *G06C 7/02* (2013.01); *H01H 2013/026* (2013.01)

(58) Field of Classification Search
CPC ..... H01H 13/83; H01H 2219/062; H01H 2221/07; H01H 2221/0702; G06F 3/0202
USPC ..... 200/314
See application file for complete search history.

(56) References Cited

U.S. PATENT DOCUMENTS 5,285,037 A * 2/1994 Baranski ..... H01H 13/70 200/314
5,329,079 A 7/1994 English et al.
5,408,060 A * 4/1995 Muurinen ..... G05G 1/02 200/310
6,027,267 A 2/2000 Yokobori
6,179,432 B1 * 1/2001 Zhang ..... G06F 3/0202 362/84
6,608,271 B2 * 8/2003 Duarte ..... H01H 9/182 200/310
6,704,004 B1 * 3/2004 Ostergård ..... H01H 13/83 178/18.11
6,762,381 B2 7/2004 Kunthady et al.
7,129,930 B1 * 10/2006 Cathey ..... G06F 3/0202 341/22
7,193,536 B2 * 3/2007 Shipman ..... G06F 3/0202 341/31
7,244,898 B2 * 7/2007 Kim ..... H01H 13/83 200/314
7,394,033 B2 * 7/2008 Kim ..... H01H 13/023 200/296
7,636,748 B2 * 12/2009 Duarte ..... G06F 1/162 345/168

(Continued)

FOREIGN PATENT DOCUMENTS

CN 201204144 Y 3/2009
EG WO 2005052971 A1 * 6/2005 ..... H01H 13/023

OTHER PUBLICATIONS

Non Final Office Action for U.S. Appl. No. 13/077,134, mailed Nov. 29, 2013, 14 pages.

(Continued)

*Primary Examiner* — Adrian S Wilson
(74) *Attorney, Agent, or Firm* — Brake Hughes Bellermann LLP

(57) ABSTRACT

In accordance with aspects of the disclosure, a computing device includes a keyboard having a keycap. The keycap includes first passageways extending between first openings in a first surface of the keycap and first openings in a second surface of the keycap. The keycap includes second passageways extending between second openings in the first surface of the keycap and second openings in the second surface of the keycap. A first light source is positioned at a first location to allow light to pass through the keycap via the first passageways and inhibit light from passing through the keycap via the second passageways. A second light source is positioned at a second location to allow light to pass through the keycap via the second passageways and inhibit light from passing through the keycap via the first passageways.

20 Claims, 17 Drawing Sheets

(56) References Cited

U.S. PATENT DOCUMENTS

| | | | | |
|---|---|---|---|---|
| 7,786,395 | B2 * | 8/2010 | Ozias | H01H 13/83 200/314 |
| 7,847,204 | B2 * | 12/2010 | Tsai | G06F 3/0202 200/310 |
| 8,063,325 | B2 | 11/2011 | Sung et al. | |
| 8,253,048 | B2 | 8/2012 | Ozias et al. | |
| 8,748,767 | B2 * | 6/2014 | Ozias | G06F 1/1662 200/310 |
| 8,890,720 | B2 * | 11/2014 | Shipman | G06F 3/0202 200/314 |
| 2002/0196618 | A1 | 12/2002 | Douzono et al. | |
| 2003/0038785 | A1 * | 2/2003 | Suzuki | G06F 1/1616 345/168 |
| 2005/0057916 | A1 * | 3/2005 | Yu | G06F 3/0202 362/84 |
| 2005/0073446 | A1 * | 4/2005 | Lazaridis | G06F 3/0202 341/22 |
| 2006/0037848 | A1 * | 2/2006 | Kobayashi | G06F 3/0202 200/310 |
| 2006/0245808 | A1 * | 11/2006 | Salman | G06F 3/0236 400/490 |
| 2008/0179172 | A1 * | 7/2008 | Sellers | H01H 13/83 200/314 |
| 2009/0224947 | A1 * | 9/2009 | Frazier | G06F 3/0202 341/22 |
| 2009/0291266 | A1 | 11/2009 | Wakisaka | |
| 2010/0258420 | A1 | 10/2010 | Tsai et al. | |
| 2011/0002724 | A1 | 1/2011 | Sauvage et al. | |
| 2011/0222298 | A1 * | 9/2011 | Hardy | B23K 26/4065 362/362 |
| 2012/0168294 | A1 | 7/2012 | Pegg | |
| 2015/0083561 | A1 | 3/2015 | Han et al. | |

OTHER PUBLICATIONS

Non Final Office Action for U.S. Appl. No. 13/077,134, mailed Feb. 27, 2013, 10 pages.
Final Office Action for U.S. Appl. No. 13/077,134, mailed Aug. 8, 2013, 9 pages.
Final Office Action for U.S. Appl. No. 13/077,134, mailed May 30, 2014, 14 pages.
Non-Final Office Action for U.S. Appl. No. 13/077,134, mailed on Oct. 2, 2014, 11 pages.
Response to Final Office Action for U.S. Appl. No. 13/077,134, filed Aug. 19, 2014, 8 pages.

* cited by examiner

KEYCAP WITH MULTI-CHARACTER DISPLAY

TECHNICAL FIELD

This description relates to features of a computing device, including a keycap with multi-character display.

BACKGROUND

Keycaps are typically used to cover and actuate switches of electronic input devices. For instance, keycaps are used to cover and actuate switches or keys of a computer keyboard. Keycaps typically include a symbol, such as a letter or number that indicates a function or association of the switch that may be activated by that particular keycap. For instance, on a typical keyboard, when a keycap marked with a letter "A" is depressed, the switch associated with the letter "A" keycap is actuated. When the keyboard is in communication with a word processor or a computer that is running word processing software, the depression of the "A" keycap and the associated actuation of the "A" switch causes the letter "A" to be introduced into the document that is being created.

Sometimes, markings on keycaps include an ink or paint marking, and sometimes, markings on keycaps are illuminated or backlit. In some implementations, a keycaps can be associated with two or more character sets. For example, keycaps of a keyboard can be associated with Latin, Cyrillic, and/or Chinese character sets, depending on a preference of a user of the keyboard. Each keycap can be marked with a corresponding Latin, Cyrillic and Chinese character, where only one of the corresponding characters is associated with the keycap at any particular time, depending on which character set is active. Thus, in some instances, a keycap may become overloaded with multiple character markings, which may tend to be small and as such difficult to see or be viewed by a user. Such keycaps may be undesirable for use in compact devices, such as compact computing devices, including laptop computers.

SUMMARY

In accordance with aspects of the disclosure, a computing device may include at least one keycap having a wall with a first surface and a second surface. The at least one keycap may include a plurality of first microscopic passageways extending between a plurality of first openings in the first surface and a plurality of first openings in the second surface. The at least one keycap may include a plurality of second microscopic passageways extending between a plurality of second openings in the first surface and a plurality of second openings in the second surface. The computing device may include a first light source positioned at a first location adjacent the second surface of the at least one keycap. The first light source and the plurality of first and second microscopic passageways may be arranged to allow light from the first light source to pass through the wall via the plurality of first microscopic passageways and inhibit light from the first light source from passing through the wall via the plurality of second microscopic passageways. The computing device may include a second light source positioned at a second location adjacent the second surface of the at least one keycap. The second light source and the plurality of first and second microscopic passageways may be arranged to allow light from the second light source to pass through the wall via the plurality of second microscopic passageways and inhibit light from the second light source from passing through the wall via the plurality of first microscopic passageways.

In accordance with aspects of the disclosure, an apparatus may include a feature including a material having an upper surface and a lower surface. The apparatus may include a first passageway extending between a first upper opening in the upper surface of the feature and a first lower opening in the lower surface of the feature. The apparatus may include a second passageway extending between a second upper opening in the upper surface of the feature and a second lower opening in the lower surface of the feature. The apparatus may include a first light source positioned underneath the feature proximate to the lower surface of the feature that provides light of a first color to pass through the feature via the first passageway. The apparatus may include a second light source positioned underneath the feature proximate to the lower surface of the feature that provides light of a second color different than the first color to pass through the feature via the second passageway. The apparatus may include a partition coupled to the lower surface of the feature. The partition may be interposed between the first light source and the second light source. The partition may be configured to separate the first lower opening of the first passageway from the second lower opening of the second passageway.

In accordance with aspects of the disclosure, a keyboard of a computing device may include a keycap having an upper surface and a lower surface. The keycap may include a first microscopic passageway extending between a first upper opening in the upper surface of the keycap and a first lower opening in the lower surface of the keycap. The keycap may include a second microscopic passageway extending between a second upper opening in the upper surface of the keycap and a second lower opening in the lower surface of the keycap. The keyboard may include a first light source positioned underneath the keycap proximate to the lower surface of the keycap that provides light of a first color to pass through the keycap via the first microscopic passageway. The keyboard may include a second light source positioned underneath the keycap proximate to the lower surface of the keycap that provides light of a second color different than the first color to pass through the keycap via the second microscopic passageway. The keyboard may include a partition interposed between the first light source and the second light source. The partition may be configured for separating the first lower opening of the first microscopic passageway from the second lower opening of the second microscopic passageway.

The details of one or more implementations are set forth in the accompanying drawings and the description below. Other features will be apparent from the description and drawings, and from the claims.

BRIEF DESCRIPTION OF THE DRAWINGS

FIGS. 4A-4C-2 are diagrams of another example keycap assembly, in accordance with aspects of the disclosure.

DETAILED DESCRIPTION

Figure 1A:
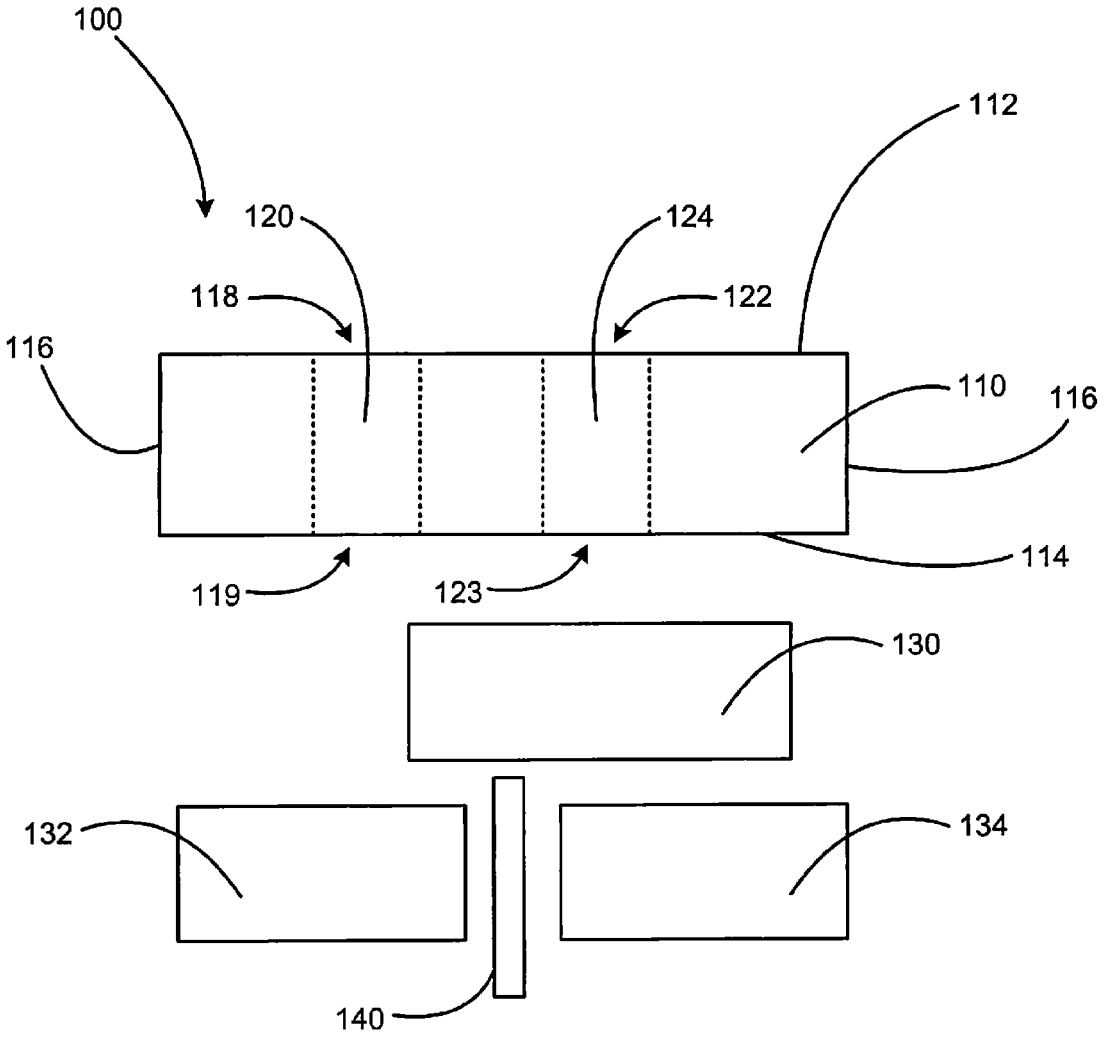
FIGS. 1A-1D-2 are diagrams of various example keycap assemblies, in accordance with aspects of the disclosure.
Figure 1B:
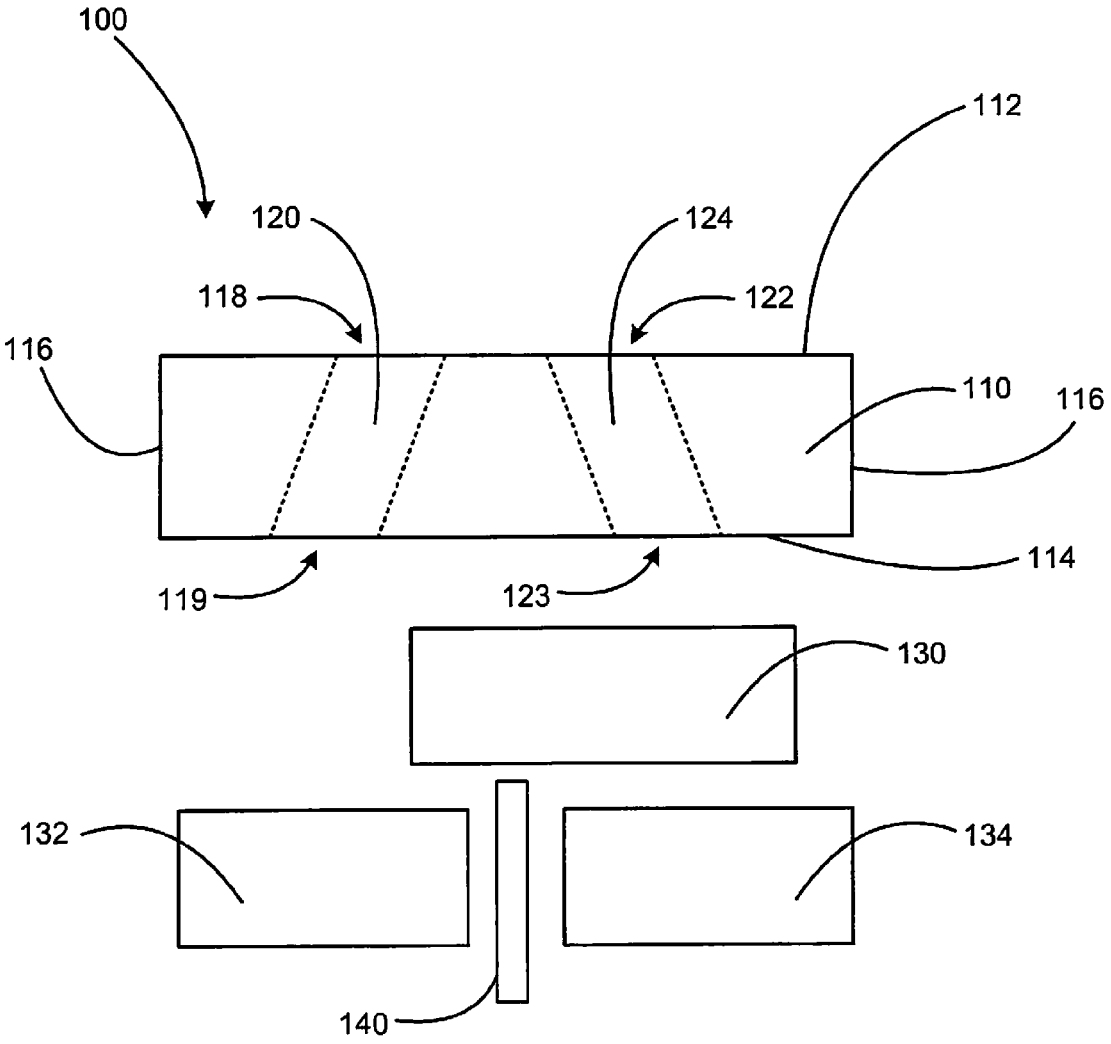
Figure 1C:
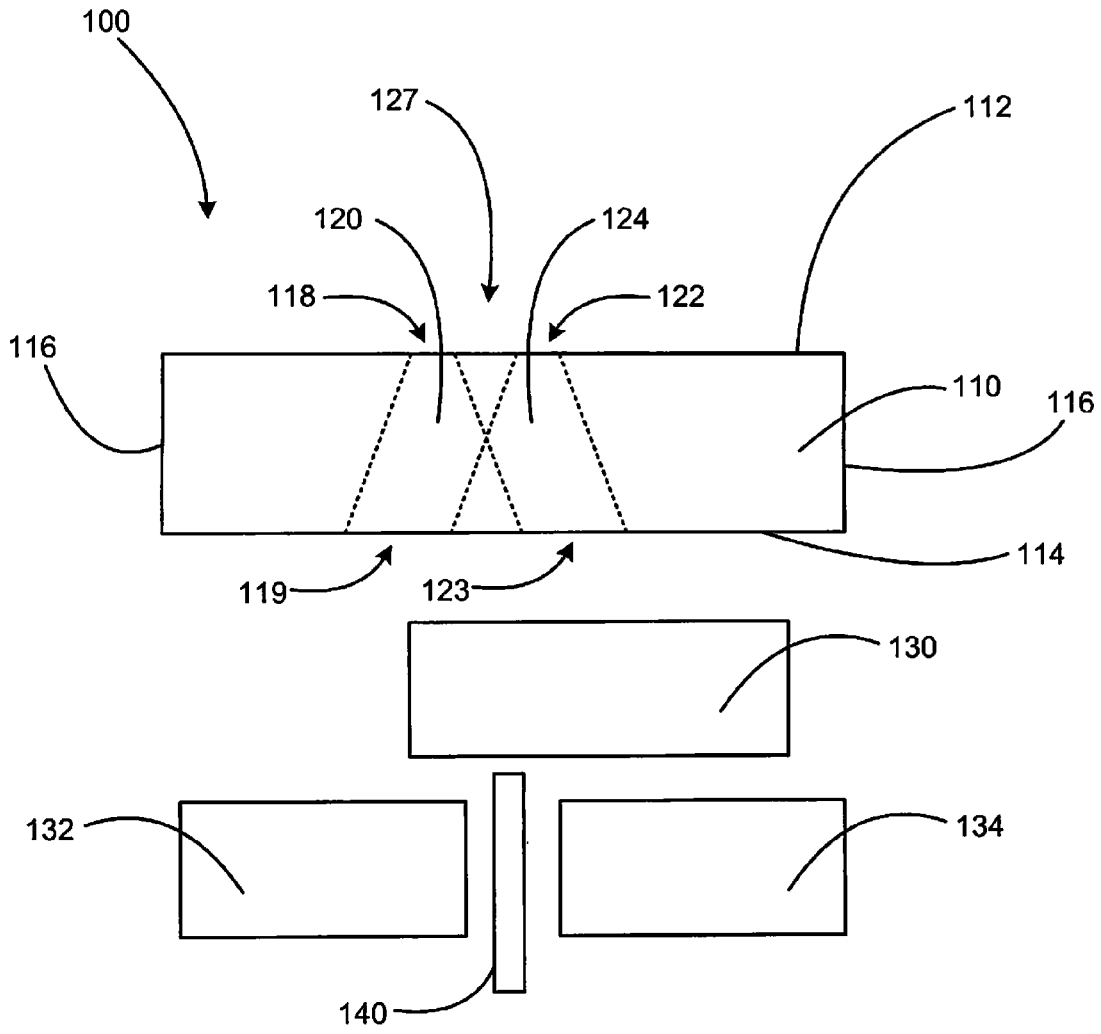

FIGS. 1A-1C are diagrams of various example keycap assemblies, in accordance with aspects of the disclosure.

FIG. 1A is a diagram of another example keycap assembly 100, in accordance with aspects of the disclosure. The keycap assembly 100 may include a keycap 110, a switch 130, and light sources 132, 134. The keycap assembly 100 may be incorporated within an input of an electronic device. The keycap assembly 100 may be included in a keyboard or other type of input device. In some implementations, a keyboard, such as a computer keyboard, may include a plurality of keycaps and keycap assemblies. The keycap 110 may be referred to as a feature, part, element, and/or component of a computer keyboard and/or a computing device. The keycap 110 may include a material, such as a solid type of material formed of plastic, metal, and/or some combination thereof.

The keycap 110 may include a first surface 112, a second surface 114, and side surfaces 116. The first surface 112 may define a plurality of openings including a first opening 118 and a second opening 122, and the second surface 114 may define a plurality of openings including a first opening 119 and a second opening 123. In some implementations, the keycap 110 may have a generally rectangular shape (e.g., when viewed from a position above the keycap). For instance, in some implementations, the upper surface 112 may have a rectangular or square shape.

In some implementations, the keycap 110 may define a plurality of passageways including a first passageway 120 and a second passageway 124 from the first surface 112 through the keycap 110 to the second surface 114. In some implementations, the keycap 110 may define the first passageway 120 extending through the keycap 110 between the first opening 118 in the first surface 112 and the first opening 119 in the second surface 114. The keycap 110 may define the second passageway 124 extending through the keycap 110 between the second opening 122 in the first surface 112 and the second opening 123 in the second surface 114. The keycap 110 may include a wall or member that is formed to define a structure of the keycap 110 and further define the first surface 112 and the second surface 114. The first passageway 120 is separate from the second passageway 124.

In some implementations, the first and second passageways 120, 122 may include first and second microscopic passageways, and the openings 118, 119, 122, 123 may include microscopic openings, which may be referred to as microscopic illumination holes. In some implementations, the first passageway 120 may include a plurality of first passageways extending between a plurality of first openings 118 in the first surface 112 and a plurality of first openings 119 in the second surface 114. Similarly, in some implementations, the second passageway 124 may include a plurality of second passageways extending between a plurality of second openings 122 in the first surface 112 and a plurality of second openings 123 in the second surface 114. Further, in some implementations, the first passageway 120 may include a plurality of first microscopic passageways, and the second passageway 124 may include a plurality of second microscopic passageways, wherein the plurality of first microscopic passageways are separate from the plurality of second microscopic passageways.

In some implementations, the term microscopic may refer to a size of the openings/holes that is large enough to allow light to pass through, and smaller than a certain diameter or smaller than a certain cross-sectional area. In some implementations, the term microscopic may refer to a size of the openings/holes in terms of some functionality, such as for example, in terms of preventing typically-sized dust particles from entering or passing through the opening/hole. In some implementations, the openings/holes include openings/holes through which light passes, and may include some type of transparent material, as described in reference to FIG. 1D-2, which allows the openings/holes allows light to pass through and also inhibit/prevent the openings/holes from becoming clogged with dirt or dust particles.

In some implementations, the first opening 118 defined by the first surface 112 of the keycap 110 may be in a shape of a first symbol, such as a first alphanumeric character, and the second opening 122 defined by the first surface 112 of the keycap 110 may be in a shape of a second symbol, such as a second alphanumeric character. In some implementations, the first opening 118 defined by the first surface 112 of the keycap 110 may be in a shape of a first symbol, such as a first international character, and the second opening 122 defined by the first surface 112 of the keycap 110 may be in a shape of a second symbol, such as a second international character. For instance, in some implementations, the first opening 118 defined by the first surface 112 of the keycap 110 may be in a shape of a first letter or may be letter-shaped in reference to various international characters, and the second opening 122 defined by the first surface 112 of the keycap 110 may be in a shape of a second letter or may be letter-shaped in reference to various international characters. In other implementations, the first opening 118 defined by the first surface 112 of the keycap 110 may be in a shape of a first number or may be number-shaped, and the second opening 122 defined by the first surface 112 of the keycap 110 may be in a shape of a second number or may be number-shaped. In yet other implementations, the first and second openings 118, 122 defined by the first surface 112 of the keycap 110 may have various shapes of other symbols including international symbols, such as a those typically found on keys of a keyboard including an international keyboard for an apparatus, such as a computer or computing device.

In some implementations, the first opening 118 defined by the first surface 112 of the keycap 110 may form a portion of a symbol, such as a letter or a number. For instance, in some implementations, the first surface 112 of the keycap 110 may define a plurality of first openings 118, the second surface 114 of the keycap 110 may define a plurality of first openings 119, and the keycap 110 may define a plurality of first passageways 120 extending through the keycap 110. Each of the plurality of first passageways 120 may extend from the first openings 118 defined by the first surface 112 of the keycap 110 to the first openings 119 defined by the second surface 114 of the keycap 110. In some implementations, the first passageways 120 may include microscopic passageways, and the first openings 118, 119 may include microscopic openings, which may be referred to as microscopic illumination holes. As such, the openings may include microscopic illumination holes, micro-drilled illumination holes, micro-perforations, etc.

In some implementations, the second opening 122 defined by the first surface 112 of the keycap 110 may form a portion of a symbol, such as a letter or a number. For instance, in some implementations, the first surface 112 of the keycap 110 may define a plurality of second openings 122, the second surface 114 of the keycap 110 may define a plurality of second openings 123, and the keycap 110 may define a plurality of second passageways 124 extending through the keycap 110. Each of the plurality of second passageways 124 may extend from the second openings 122 defined by the first surface 112 of the keycap 110 to the second openings 123 defined by the second surface 114 of the keycap 110. In some implementations, the second passageways 124 may include microscopic passageways, and the second openings 122, 123 may include microscopic openings, which may be referred to as microscopic illumination holes.

In some implementations, the plurality of first openings 118 defined by the first surface 112 of the keycap 110 may collectively form a shape of a first symbol including a first international symbol. For instance, in some implementations, the plurality of first openings 118 defined by the first surface 112 of the keycap 110 may form a first single letter or alphanumeric shape. In other implementations, the plurality of first openings 118 defined by the first surface 112 of the keycap 110 may form a first number shape or the shape of another symbol.

In some implementations, the plurality of second openings 122 defined by the first surface 112 of the keycap 110 may collectively form a shape of a second symbol including a second international symbol. For instance, in some implementations, the plurality of second openings 122 defined by the first surface 112 of the keycap 110 may form a second single letter or alphanumeric shape. In other implementations, the plurality of second openings 122 defined by the first surface 112 of the keycap 110 may form a second number shape or the shape of another symbol.

In some implementations, the first surface 112 of the keycap 110 may define many openings (e.g., microscopic openings). For instance, in some implementations, the first surface 112 of the keycap may define 300, 500 or more openings (e.g., microscopic openings). Each individual opening may have a circular or oval shape and may collectively form an alphanumeric symbol or an international symbol, which may include different characters of different character sets, wherein each character set may include various language character sets, such as, for example, English, his Latin, Cyrillic, Chinese, Korean, etc. character sets. In some implementations, the first and second openings 118, 122 defined by the first surface 112 of the keycap 110 are microscopic and respectively define openings to the first and second passageways 120, 124 (e.g., microscopic passageways). In some such implementations, the small, microscopic openings may assist with inhibiting and/or preventing dust, dirt, and other unwanted materials from entering the openings and passageways. For instance, the openings/holes may be smaller than a certain critical size, such that they inhibit/prevent dirt from getting in. In another instance, in reference to FIG. 1D-1, a thin, transparent film coating or layer be placed/positioned over the first surface 112 to inhibit/prevent dirt, dust, and/or debris from entering the openings/holes. Further, in reference to FIG. 1D-2, the openings/holes may include some type of transparent material formed therein to inhibit/prevent the openings/holes from becoming clogged with dirt or dust particles.

The keycap assembly 100 may include first light source 132 and second light source 134. The first light source 132 may be positioned at a first location adjacent the second surface 114 of the keycap 110. The first light source 132, the first passageway 120, and the second passageway 124 may be arranged to allow light from the first light source 132 to pass through the keycap 110 via the first passageway 120 and inhibit light from the first light source 132 from passing through the keycap 110 via the second passageway 124. The second light source 134 may be positioned at a second location adjacent the second surface 114 of the keycap 110. The second light source 134, the first passageway 120, and the second passageway 124 may be arranged to allow light from the second light source 134 to pass through the keycap 110 via the second passageway 124 and inhibit light from the second light source 134 from passing through the keycap 110 via the first passageway 120.

In some implementations, as described herein, the first passageway 120 may include a plurality of first microscopic passageways extending between a plurality of first openings 118 in the first surface 112 and a plurality of first openings 119 in the second surface 114, and the second passageway 124 may include a plurality of second passageways extending between a plurality of second openings 122 in the first surface 112 and a plurality of second openings 123 in the second surface 114. Accordingly, the first light source 132 may be positioned at the first location adjacent the second surface 114 of the keycap 110 such that the first light source 132 and the plurality of first and second microscopic passageways 120, 124 may be arranged to allow light from the first light source 132 to pass through the keycap 110 via the plurality of first microscopic passageways 120 and inhibit light from the first light source 132 from passing through the keycap 110 via the plurality of second microscopic passageways 124. Further, the second light source 134 may be positioned at a second location adjacent the second surface 114 of the keycap 110 such that the second light source 134 and the plurality of first and second microscopic passageways 120, 124 may be arranged to allow light from the second light source 134 to pass through the keycap 110 via the plurality of second microscopic passageways 124 and inhibit light from the second light source 134 from passing through the keycap 110 via the plurality of first microscopic passageways 120.

The keycap assembly 100 may include a partition 140 that is positioned adjacent (and/or coupled to) the second surface 114 of the keycap 110. The partition 140 may be interposed between the first position of the first light source 132 and the second position of the second light source 134. The partition 140 may be configured to separate the first opening 119 in the second surface 114 of the keycap 110 for the first passageway 120 from the second opening 123 in the second surface 114 of the keycap 110 for the second passageway 124. The partition 140 may be one of a plurality of partitions. The partition 140 may be referred to as a light divider.

In some implementations, as described herein, the first passageway 120 may include a plurality of first microscopic passageways extending between a plurality of first openings 118 in the first surface 112 and a plurality of first openings 119 in the second surface 114, and the second passageway 124 may include a plurality of second microscopic passageways extending between a plurality of second openings 122 in the first surface 112 and a plurality of second openings 123 in the second surface 114. The partition 140 may be configured to separate the plurality of first openings 119 in the second surface 114 of the keycap 110 for the plurality of first microscopic passageways 120 from the plurality of second openings 123 in the second surface 114 of the keycap 110 for the plurality of second microscopic passageways 124. In some implementations, each of the openings 118, 119, 122, 123 may each include microscopic illumination holes associated with microscopic passageways.

In some implementations, the first surface 112 of the keycap 114 may include an upper surface of the keycap 110, and the second surface 114 of the keycap 114 may include a lower surface of the keycap 114. In some implementations, the first opening 118 may include a plurality of first openings in the first surface 112 of the keycap 110 that are contoured in a first shape, and the second opening 122 may include a plurality of second openings in the first surface 112 of the keycap 110 that are contoured in a second shape that is different than the first shape. In some implementations, the first opening 118 may include a plurality of first openings in the first surface 112 of the keycap 110 that are contoured in a first shape of a first alphanumeric character, and the second opening 122 may include a plurality of second openings in the first surface 112 of the keycap 110 that are contoured in a second shape of a second alphanumeric character that is different than the first alphanumeric character. In some implementations, the first shape and the second shape may overlap on the first surface 112 of the keycap 110. In some implementations, the first shape and the second shape may substantially overlap on the first surface 112 of the keycap 110, and a display area of the overlapping first and second shapes may occupy a substantial portion of a surface area of the first surface 112 of the keycap 110.

In various example implementations, aspects of the disclosure may be used generally and are thus not limited to the specific implementations described in this specification (e.g., computers, audio equipment, etc.). As such, various aspects of the disclosure may be applied to and/or implemented in any type of system and/or device including any surface thereof that may benefit from using angled laser etched holes (or openings) to display multiple characters and/or segments thereof in one or more spots or positions using multiple light sources, in a manner as described herein.

In some implementations, as shown in FIG. 1B, the first passageway 120 may be arranged at a first angle in reference to the first surface 112 and the second surface 114 of the keycap 110, and the second passageway 124 may be arranged at a second angle in reference to the first surface 112 and second surface 114 of the keycap 110, wherein the second angle is different than the first angle. In some implementations, the first passageway 120 may include a plurality of first microscopic passageways that are each arranged at the first angle in reference to the first surface 112 and the second surface 114 of the keycap 110, and the second passageway 124 may include a plurality of second microscopic passageways that are each arranged at the second angle in reference to the first surface 112 and second surface 114 of the keycap 110, wherein the second angle is different than the first angle. In some implementations, as shown in FIG. 1B, the first angle may include a first angular orientation in a first direction, and the second angle may include a second angular orientation in a second direction that is different than the first direction. In some implementations, the first angle may include the first angular orientation of greater than 0° and less than 90° from the first surface 112 of the keycap 110, and the second angle may include the second angular orientation of greater than 90° and less than 180° from the first surface 112 of the keycap 110.

In some implementations, as shown in FIG. 1C, the first passageway 120 may be arranged at the first angle, and the second passageway 124 may be arranged at the second angle that is different than the first angle, wherein an overlap portion 127 of the first and second passageways 120, 124 adjacent the first surface 112 may overlap and/or occupy a same area of the keycap 110. In some implementations, the first passageway 120 may include a plurality of first microscopic passageways that are each arranged at the first angle, and the second passageway 124 may include a plurality of second microscopic passageways that are each arranged at the second angle that is different than the first angle, wherein the overlap portion 127 of the plurality of first and second microscopic passageways 120, 124 adjacent the first surface 112 may overlap and/or occupy a same area of the keycap 110. In some implementations, as shown in FIG. 1C, the first angle may include a first angular orientation in a first direction, and the second angle may include a second angular orientation in a second direction that is different than the first direction. In some implementations, as shown in FIG. 1C, the first angle may include the first angular orientation of greater than 0° and less than 90° from the first surface 112 of the keycap 110, and the second angle may include the second angular orientation of greater than 90° and less than 140° from the first surface 112 of the keycap 110.

In some implementations, one or more of the plurality of first and second passageways 120, 124 may include different angles including normal angles to achieve display of the first and second shapes or symbols at the first surface 112 of the keycap 110. For instance, the plurality of first passageways 120 may include one or more passageways having an angle of, e.g., 34°, one or more passageways having an angle of, e.g., 57°, and one or more passageways having an angle of, e.g., 90°. Further, in this instance, the plurality of second passageways 124 may include one or more passageways having an angle of, e.g., 47°, one or more passageways having an angle of, e.g., 90°, and one or more passageways having an angle of, e.g., 30°. In some implementations, some of the plurality of first and second passageways 120, 124 may crisscross and/or overlap through the keycap 110.

The first light source 132 may be configured to emit a first color of light, and the second light source 134 may be configured to emit a second color of light. In various implementations, the first and second colors of light may be of a same color or of a different color. As such, the first color of light may be a same color of light as the second color of light, or the first color of light may be a different color of light than the second color of light. For instance, the first color of light may be an orange color of light, and the second color of light may be an orange color of light. In another instance, the first color of light may be a green color of light, and the second color of light may be a red color of light. However, the color or colors of light may be any useable color of light in the visible spectrum, such as blue, yellow, purple, or white light, or some other useable color. In some implementations, the first light source 132 may include a first light emitting diode (LED) that is configured to emit a first color of light, and the second light source 134 may include a second light emitting diode (LED) that is configured to emit a second color of light that is different than the first color of light.

The first light source 132 may be configured to emit a first color of light and create a first path of light through the first passageway 120 of the keycap 110. The second light source 134 may be configured to emit a second color of light and create a second path of light through the second passageway 124 of the keycap 110. In an implementation, the first color of light of the first path of light may be a same color of light as the second color of light of the second path of light. In another implementation, the first color of light of the first path of light may be a different color of light than the second color of light of the second path of light.

The light sources 132, 134 may be configured to illuminate the keycap 110, or different portions, sides, or areas of the keycap 110, thereby allowing light to pass thru the keycap 110 via the first and second passageways 120, 124. In some instances, by using multiple light sources 132, 134 for the keycap 110, a user may select the display of certain character sets on the keycap 110. In some implementations, key legends are etched with a micro-drilling or laser drilling technique, wherein the etched key legends create microscopic illumination holes allowing light to pass through the keycap 110. The light sources 132, 134 may be configured to illuminate the keycap 110 from underneath the keycap 110, using a backlighting technique. In some implementations, the light sources 132, 134 may be positioned underneath the keycap 110. The passageways may be formed using laser drilling or piercing at various angles to create microscopic passageways at various angles to form angular passageways. In other implementations, the laser drilling or piercing may be used to laser drill or pierce a structural housing of a computing device or keyboard at one or more various angles to form angled microscopic illumination holes or openings. As such, a structural housing of a computing device may be laser drilled or pierced at one or more various angles to form angled microscopic illumination holes or openings. In some implementations, by forming micro-drilled display regions in a structural housing of a computing device, messages including error messages may be displayed to a user.

In some implementations, the keycap assembly 100 may include one or more additional passageways formed in the keycap 110 along with the first and second passageways 120, 124. Further, the keycap assembly 100 may include one or more additional light sources along with the first and second light sources 132, 134 to provide light to the one or more additional passageways. Accordingly, the keycap 110 may be configured to display or illuminate one or more additional symbols or characters including international characters. For instance, the keycap 110 may be configured to display or illuminate any number of symbols or characters (e.g., 1, 2, 3, 4, 5, 6, etc.) including international characters to a user depending on which of the one or more corresponding light sources is selected to be illuminated by the user. In another instance, different symbols or characters may be selectively displayed and/or illuminated via the keycap 110 by selectively switching the different light sources 132, 134 (e.g., LEDs) to illuminate the openings 120, 124 via the passageway, respectively.

In accordance with aspects of the disclosure, a computing device may be part of a system that includes a keyboard having one or more keycaps including, in an example, the keycap 110. The computing device may include memory configured to store instructions and at least one processor that is configured to execute the stored instructions. In some implementations, the instructions may configure the keyboard for use with a particular character set (e.g., English, Latin, Chinese, etc.), and a backlight module may be configured to turn on/off either of the first and second light sources 132, 134 to display a first or second character set, respectively, to the user.

By using separate and different-colored LEDs, the keycap 110 may be configured to illuminate each character individually via separate light passageways 120, 124 formed through the keycap 110 via, for example, laser etching, micro-laser etching, laser perforating, etc. As such, a single keycap 110 may be used to illuminate multiple characters on an upper surface that are contoured as shapes of the characters with the openings of the passageways 120, 124 and the light passing through the passageways 120, 124 of the keycap 110 from the light sources 132, 134. By user selection of which color LED light is chosen to illuminate the keycap 110, multiple different characters may appear one at time in large font for good legibility and usability for viewing by the user.

Further, aspects of the disclosure may be applied to other surfaces and/or features and/or components of an apparatus, device, computing device, etc. For instance, in some implementations, techniques of the disclosure may be applied to a feature of an apparatus including a housing of the apparatus, wherein the first/upper surface of the feature may include an outer surface of the housing, and the second/lower surface of the feature may include an inner surface of the housing. In various implementations, the apparatus may include any type of device, computing device, computer, mobile phone, etc., wherein any surfaces of the device may be configured to display multiple symbols and/or shapes in multiple illuminated colors in a same area via microscopic openings and passageways, in a manner as described herein.

In some implementations, the keycap 110 may be formed of an opaque material (e.g., where light does not pass through the material). For instance, in some implementations, the keycap 110 may be formed of a metal material. Specifically, in some implementations, the keycap 110 may be formed of a material that may include steel, aluminum, titanium, magnesium, copper, brass, nickel, tin, or some combination thereof. In other implementations, the keycap 110 may be formed of carbon, carbon fiber, nano-tube reinforced plastic, glass, ceramic, resin, or some combination thereof. In some implementations, the keycap 110 may be formed of a mixture of materials. In some implementations, such mixture of materials may include a metal material.

In some implementations, the keycap 110 may be formed of an opaque material (e.g., such as a metal material) and a transparent material. For instance, in one implementation, the opaque material of the keycap 110 may define the passageways 120, 124 and a transparent material may be coupled to the opaque material and disposed within the passageways 120, 124 defined by the opaque material. In some implementations, the opaque material may include a metal material and the transparent material may include a plastic material. In some implementations, the opaque material may include a plastic material and the transparent material may include a plastic material. In some implementations, the transparent material may include a silicon or glass material. For instance, in reference to FIG. 1D-1, a transparent film/layer may be positioned on (and/or coupled to) the first surface 112 of the keycap 110. In another instance, in reference to FIG. 1D-2, a transparent film/layer may be positioned in (and/or coupled in) the first and second passageways 120, 124 of the keycap 110.

The keycap 110 may be configured to actuate the switch 130 when the keycap 110 is selected by a user. For instance, in some implementations, a user may select the keycap 110 by depressing the keycap 110 (e.g., such as depressing a key on a computer keyboard). The depressed keycap 110 may be configured to actuate the switch 130, which may be disposed beneath the keycap 110.

In some implementations, the keycap 110 may be biased to its un-depressed state. Thus, a user may apply a force to the keycap 110 to depress the keycap 110 and actuate the switch 130. Once the user releases or removes the force from the keycap 110, the keycap 110 returns to its un-depressed state or configuration. In some implementations, the keycap assembly 100 may include a keycap return mechanism that may be configured to bias the keycap 110 into its un-depressed configuration. For instance, the keycap return mechanism may include a hinge system or a spring that may be configured to bias the keycap 110 into its un-depressed configuration.

In some implementations, the keycap assembly 100 may include a support structure that may be configured to provide support to the keycap. In some implementations, the support structure may be configured to help prevent the keycap from tilting. In some implementations, the support structure may be configured to bias the keycap into its un-depressed state.

The switch 130 may be any type of mechanical or electrical switch that may be configured to communicate with a display or other device. For instance, in some implementations, the switch 130 may be an electrical switch and may be configured to communicate with a computer system. Specifically, in some implementations, the switch 130 may be configured to communicate with at least least one processor, such as a central processing unit (CPU), and a display device (monitor) or a computer system.

For instance, in some implementations, the switch 130 may be an electrical switch. When such a switch 130 may be actuated or activated, a metal contact of the switch contacts and completes an electrical circuit to communicate to the display or other device that the switch 130 may have been actuated.

The first light source 132 may be configured to generate light and emit light through the first passageway 120 defined by the keycap 110, and the second light source 134 may be configured to generate light and emit light through the second passageway 124 defined by the keycap 110. In some implementations, the light sources 132, 134 may be disposed such that the keycap 110 may be disposed between the user and the light sources 132, 134. In some implementations, the light sources 132, 134 may be disposed adjacent to or proximate to the second surface 114 of the keycap 110. In some implementations, the light sources 132, 134 may be disposed such that the second surface 114 of the keycap 110 may be disposed between the light sources 132, 134 and the first surface 112 of the keycap 110. In some implementations, the partition 140 may be interposed between the first and second light sources 132, 134.

As the light sources 132, 134 may be configured to respectively emit light through the passageways 120, 124 of the keycap 110, the keycap 110 may be backlit by one or more colors of light. As the light may be emitted through the passageways 120, 124 and out of the openings 118, 122 defined by the first surface 112 of the keycap 110, the shapes of the openings 118, 122 defined by the first surface 112 of the keycap 110 may be illuminated to the user. Specifically, if the first opening 118 defined by the first surface 112 of the keycap 110 is letter-shaped representing a first character, the illumination of the keycap 110 may be shaped like the first letter-shaped character represented by a first shape of a first letter. Further, if the second opening 122 defined by the first surface 112 of the keycap 110 is letter-shaped representing a second character, the illumination of the keycap 110 may be shaped like the second letter-shaped character represented by a second shape of a second letter.

The light sources 132, 134 may include any device that generates or emits a light. For instance, in some implementations, the light sources 132, 134 may include a light guide film that guides light from a distant source to under the keycap 110. In other implementations, the light sources 132, 134 may include a light emitting diode (LED) positioned approximately under the keycap 110.

In some implementations, the light sources 132, 134 may be used to emit light through the passageways 120, 124 of a plurality of keycaps 110. For instance, a keyboard may include ten keycaps and switches and include one light source for each of the passageways 120, 124. In such an implementation, the passageways 120, 124 defined by each of the keycaps 110 may be illuminated by separate and different light sources 132, 134, respectively.

In some implementations, the light emitted through the keycap 110 may be directed in one or more directions. For instance, in some implementations, the light emitted through the openings 118, 122 and respective passageways 120, 124 of the keycap 110 may be directed in different directions toward a user of the keyboard or computer system. In some implementations, the light emitted through the openings 118, 122 and respective passageways 120, 124 of the keycap 110 may be directed away from non-users of the keyboard or computer system and only toward the user of the system.

In some implementations, the first surface 112 of the keycap 110 may include many first openings 118 and passageways 120 that extend to many second openings 119 defined by the second surface 114 of the keycap 110, and the first surface 112 of the keycap 110 may include many first openings 122 and passageways 124 that extend to many second openings 123 defined by the second surface 114 of the keycap 110. In some implementations, the ratio of the length of the passageways 120, 124 (e.g., the thickness of the keycap 110, or wall of the keycap 110) to the diameter or width of the first openings 118, 122 defined by the first surface 112 may be sufficient for light to pass through the passageways 120, 124, respectively. In some implementations, the ratio of the length of the passageways 120, 124 to the diameter of the first openings 118, 122, respectively, defined by the first surface 112 may be sufficient to allow light to be transmitted through the passageways 120, 124, respectively, toward a user located in front of the keyboard or computer system and away from the sides of the keyboard.

In some such implementations, the passageways 120, 124 (e.g., the thickness of the keycap 110) may have a length of about 1 mm. In other implementations, the passageways 120, 124 (e.g., the thickness of the keycap 110) may have a length of less than about 0.5 mm. For instance, in some implementations, the passageways 120, 124 (e.g., the thickness of the keycap 110) may have a length of between 0.2 mm and 0.5 mm. In some implementations, the first openings 118, 122 in the first surface 112 of the keycap 110 may be circular, and the diameter of the first openings 118, 122 may be less than 1 mm.

Figures 1, 1D:
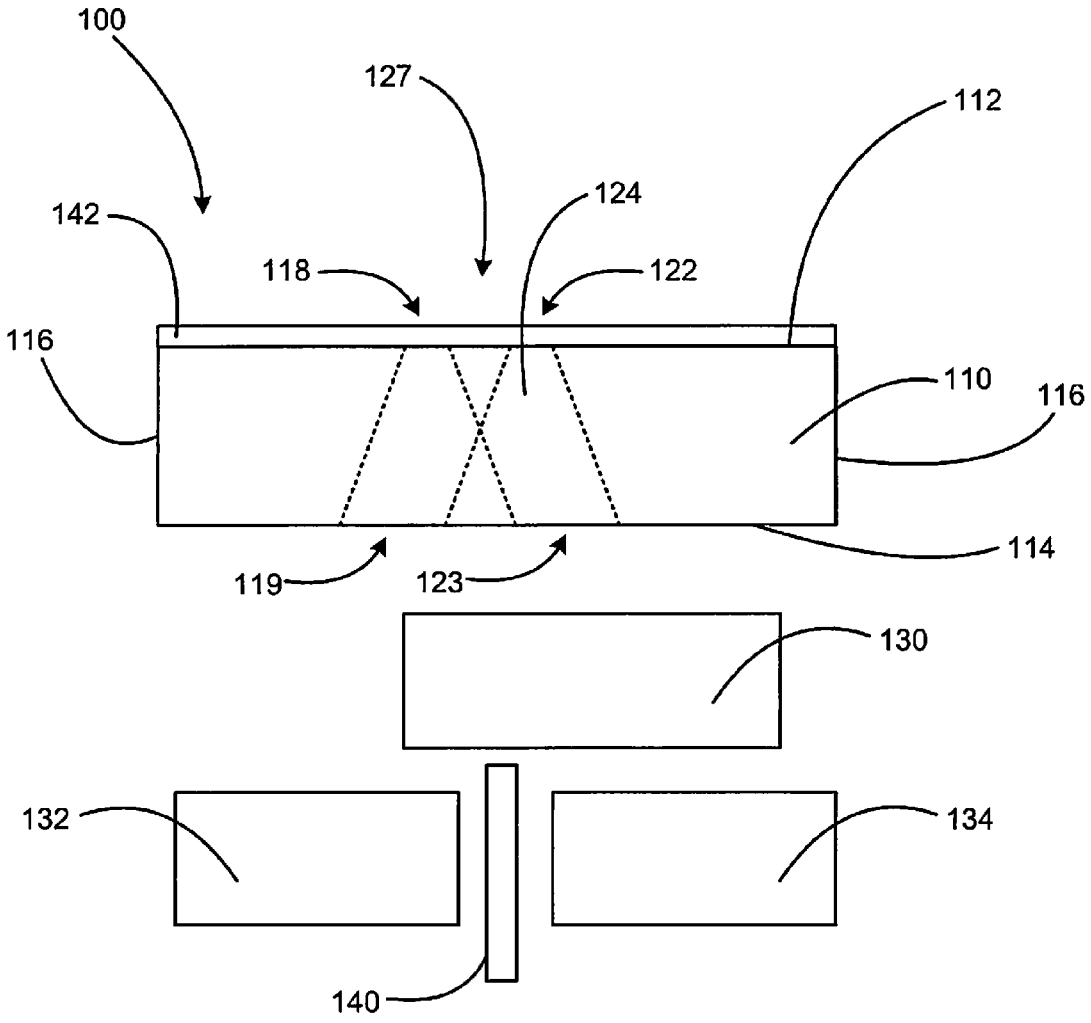

In some implementations, as shown in reference to FIG. 1D-1, the keycap assembly 100 may include a light diffusion layer 142 (or transparent film/layer) position adjacent (or coupled to) the first surface 112 of the keycap 110. The light diffusion layer 142 may include translucent/transparent material or slightly translucent/transparent material of various thicknesses that may be configured to diffuse light emanating from the first and second passageways 120, 124 via the first openings 118, 122, respectively, of the keycap 110.

Figures 1, 1D, 2:
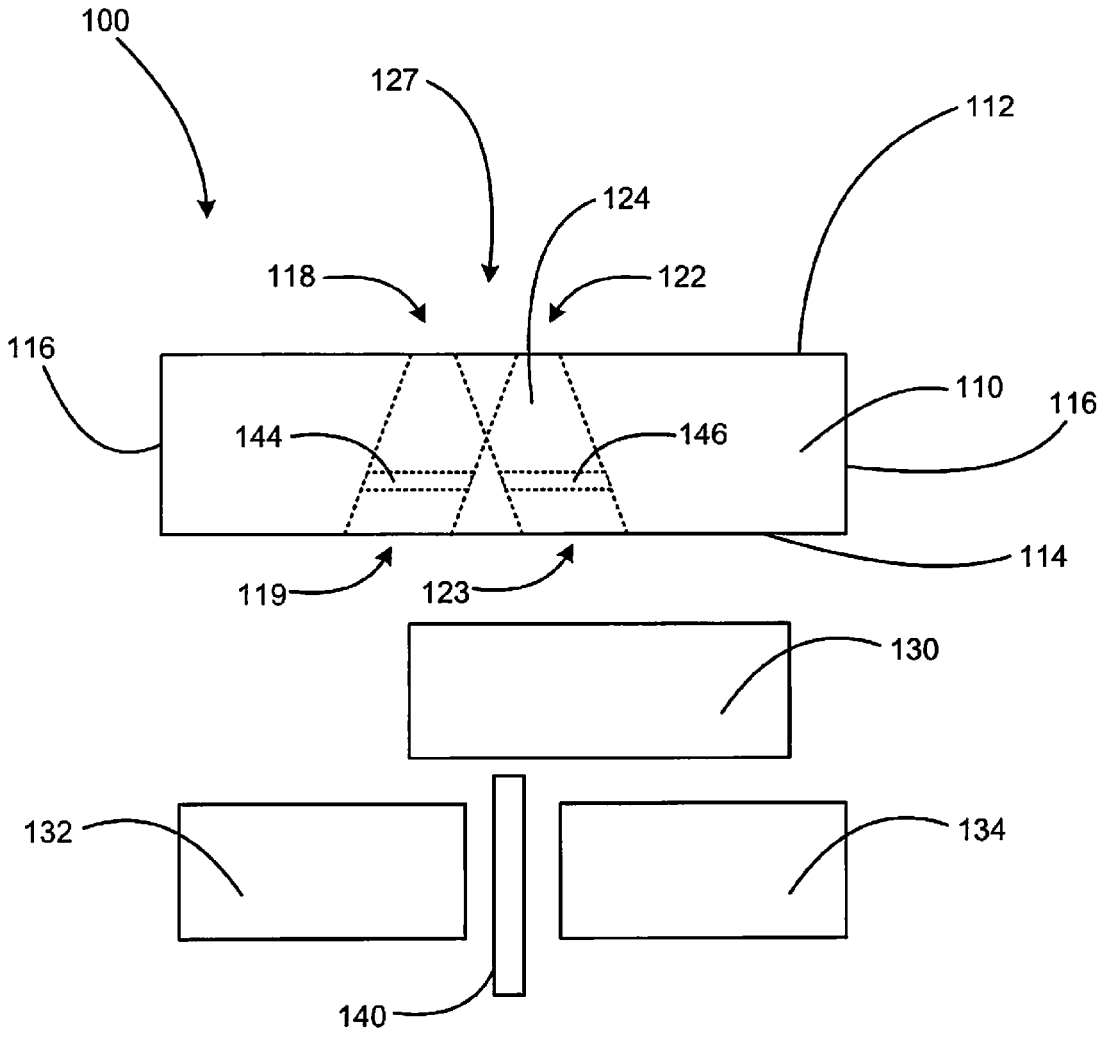

In some implementations, as shown in FIG. 1D-2, the keycap assembly 100 may include first and light diffusion layers 144, 146 (or transparent films/layers) positioned in (or coupled in) the first and second passageways 120, 124, respectively, of the keycap 110. The light diffusion layers 144,146 may include translucent/transparent material or slightly translucent/transparent material of various thicknesses that may be configured to diffuse light emanating through the first and second passageways 120, 124, respectively, of the keycap 110. The light diffusion layers 144,146 may be positioned within (or coupled within) the first and second passageways 120, 124, respectively, at any position along a length of the first and second passageways 120, 124, respectively, of the keycap 110 including adjacent (or proximate to) the first surface 112 of the keycap 110.

Figure 2A:
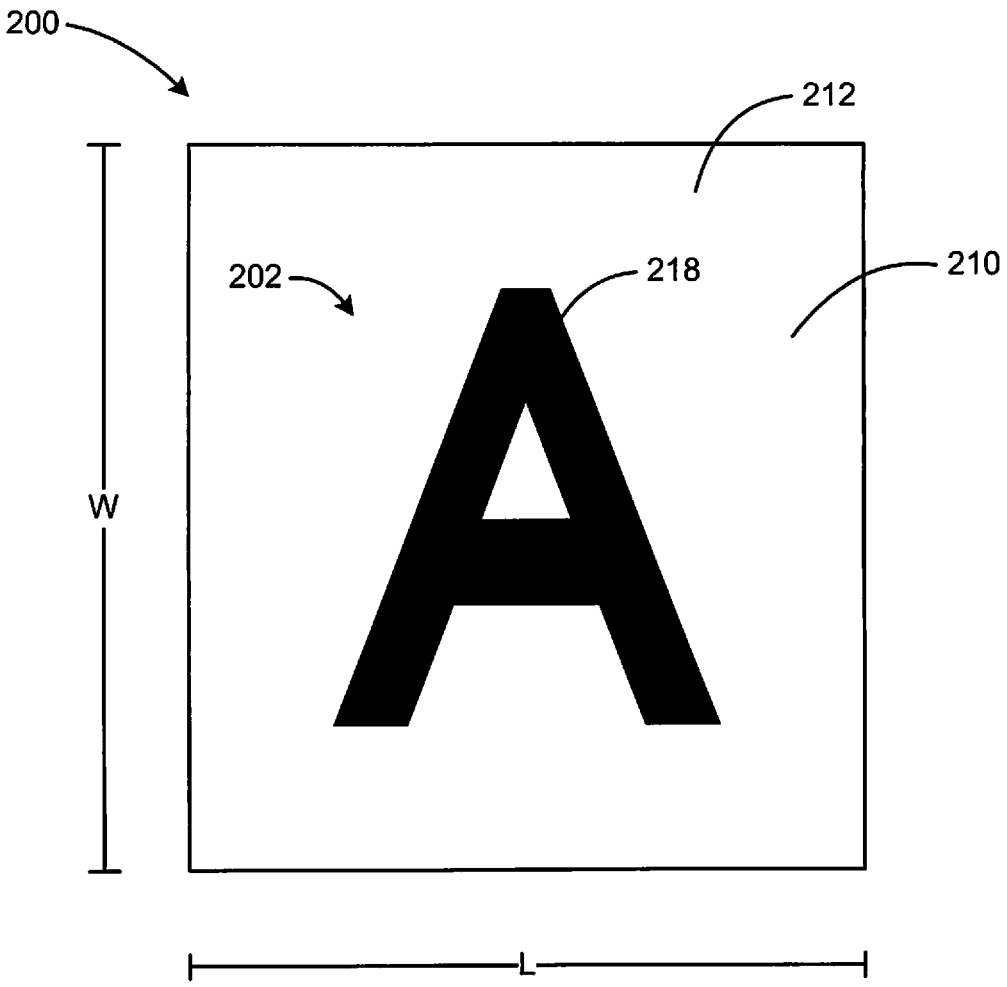
FIGS. 2A-2C are diagrams of another example keycap assembly, in accordance with aspects of the disclosure.
Figure 2B:
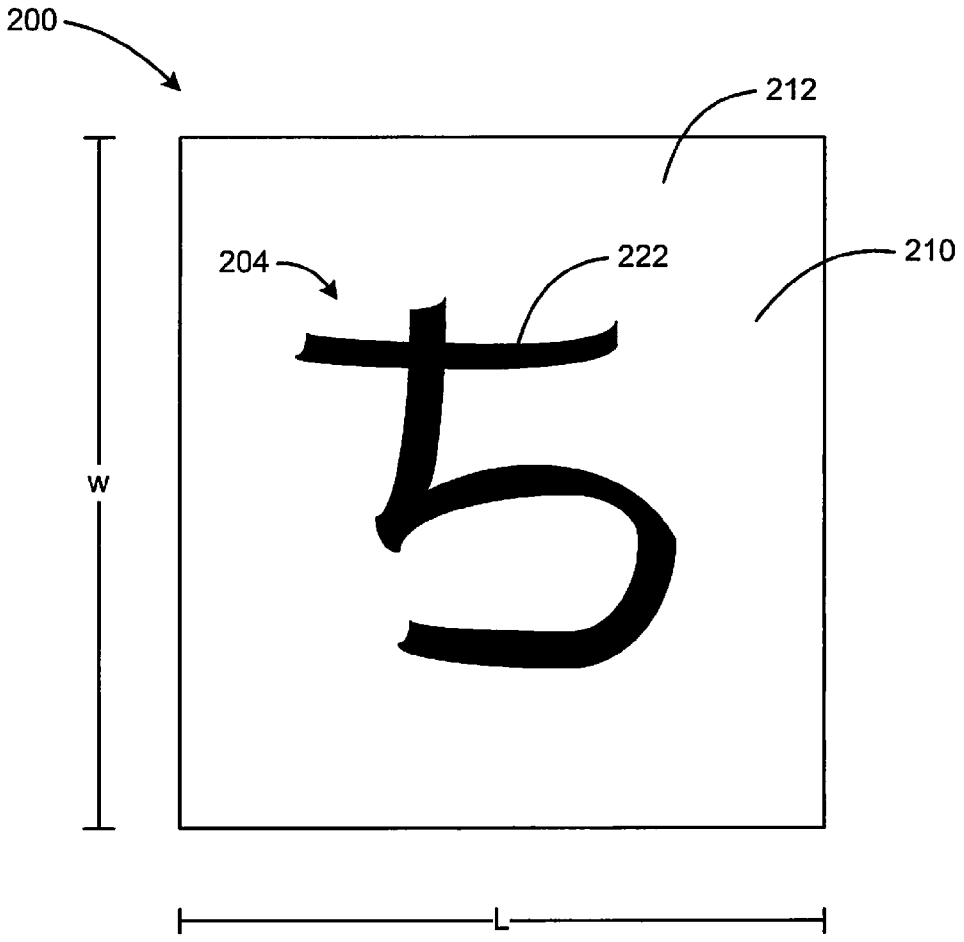
Figure 2C:
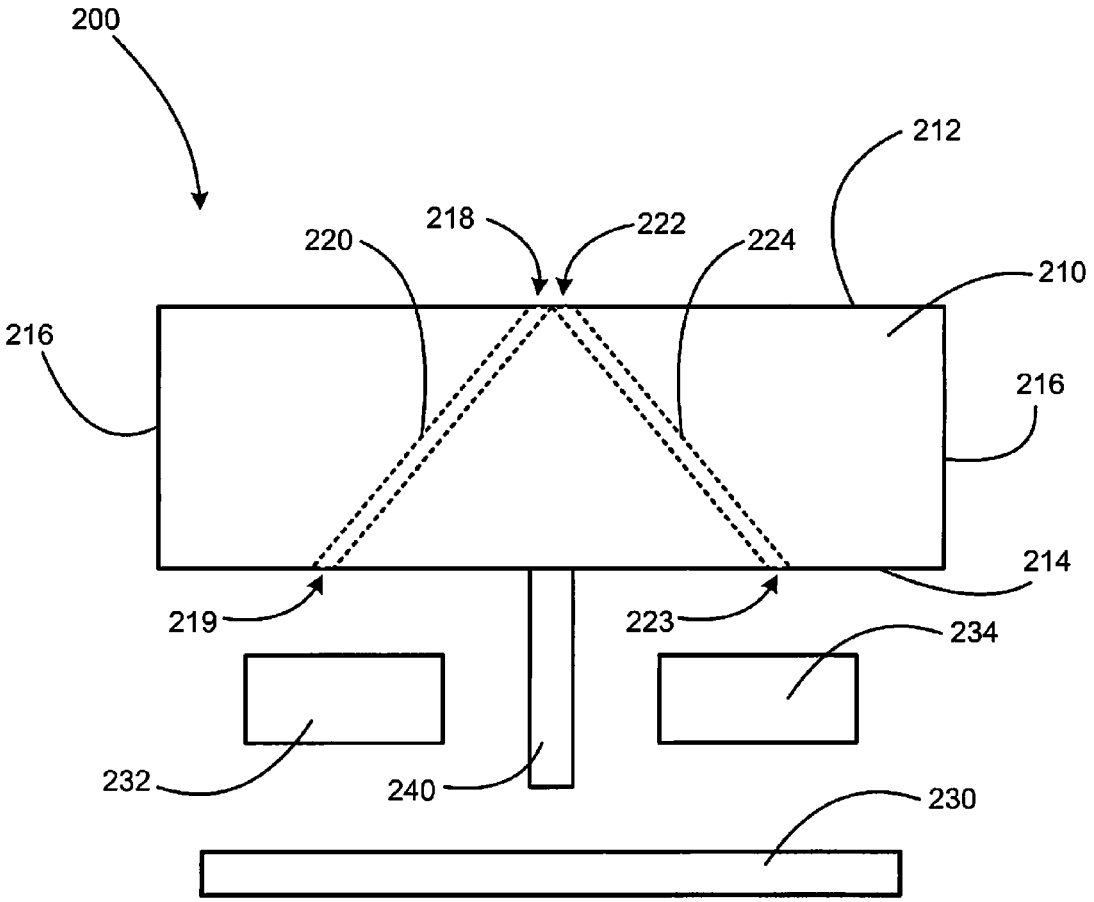

FIGS. 2A-2C are diagrams of another example keycap assembly, in accordance with aspects of the disclosure.

FIG. 2A is a top view of a keycap assembly 200 showing a first symbol 202 when illuminated by a first light source 232 (shown in FIG. 2C). FIG. 2B is another top view of the keycap assembly 200 showing a second symbol 204 when illuminated by a second light source 234 (shown in FIG. 2C). FIG. 2C is a cross-sectional view of the keycap assembly 200 taken along line A-A of FIG. 2A and B-B of FIG. 2B.

The keycap assembly 200 may include a keycap 210, a switch 230, light sources 232, 234, and a partition 240. The keycap 210 may include an upper surface 212, a lower surface 214, and side surfaces 216. The upper surface 212 may define a first opening 218, and the upper surface 212 may define a second opening 222. In the illustrated implementations, the first opening 218 defined by the upper surface 212 may be in the shape of a first symbol 202, such as, for example, an alphanumeric character, and the second opening 222 defined by the upper surface 212 may be in the shape of a second symbol 204, such as, for example, an international character.

The lower surface 214 of the keycap 210 may define a first opening 219, and the lower surface 214 of the keycap 210 may define a second opening 223. The keycap 210 may define a first passageway 220 that may extend through the keycap 210 from the first opening 218 defined by the upper surface 212 to the first opening 219 defined by the lower surface 214, and the keycap 210 may define a second passageway 224 that may extend through the keycap 210 from the second opening 222 defined by the upper surface 212 to the second opening 223 defined by the lower surface 214.

The first passageway 220 may include a plurality of first microscopic passageways extending between a plurality of first openings 218 in the upper surface 212 and a plurality of first openings 219 in the lower surface 214, and the second passageway 224 may include a plurality of second microscopic passageways extending between a plurality of second openings 222 in the upper surface 212 and a plurality of second openings 223 in the lower surface 214. The first light source 232 may be positioned at a first location adjacent the lower surface 214 of the keycap 210 such that the first light source 232 and the plurality of first and second microscopic passageways 220, 224 may be arranged to allow light from the first light source 232 to pass through the keycap 210 via the plurality of first microscopic passageways 220 and inhibit light from the first light source 232 from passing through the keycap 210 via the plurality of second microscopic passageways 224. Further, the second light source 234 may be positioned at a second location adjacent the lower surface 214 of the keycap 210 such that the second light source 234 and the plurality of first and second microscopic passageways 220, 224 may be arranged to allow light from the second light source 234 to pass through the keycap 210 via the plurality of second microscopic passageways 224 and inhibit light from the second light source 234 from passing through the keycap 210 via the plurality of first microscopic passageways 220.

The keycap assembly 100 may include the partition 240 that is positioned adjacent the lower surface 214 of the keycap 210. The partition 240 may be interposed between the first position of the first light source 232 and the second position of the second light source 234. The partition 240 may be configured to separate the first opening 219 in the lower surface 214 of the keycap 210 for the first passageway 220 from the second opening 223 in the lower surface 214 of the keycap 210 for the second passageway 224. The partition 240 may be one of a plurality of partitions.

In some implementations, the first passageway 220 may include a plurality of first microscopic passageways extending between a plurality of first openings 218 in the upper surface 212 and a plurality of first openings 219 in the lower surface 214, and the second passageway 224 may include a plurality of second microscopic passageways extending between a plurality of second openings 122 in the upper surface 112 and a plurality of second openings 123 in the lower surface 114. The partition 140 may be configured to separate the plurality of first openings 119 in the lower surface 114 of the keycap 110 for the plurality of first microscopic passageways 120 from the plurality of second openings 123 in the lower surface 114 of the keycap 110 for the plurality of second microscopic passageways 124. In some implementations, each of the openings 118, 119, 122, 123 may each include microscopic illumination holes associated with microscopic passageways.

In some implementations, the first opening 218 may include a plurality of first openings in the upper surface 212 of the keycap 210 that are contoured in the first symbol 202 (or shape), and the second opening 222 may include a plurality of second openings in the upper surface 212 of the keycap 210 that are contoured in the second symbol 204 (or shape) that may be different than the first symbol 202. The first opening 218 may include a plurality of first openings in the upper surface 212 of the keycap 110 that are contoured in the first symbol 202, such as a shape of a first alphanumeric character, and the second opening 122 may include a plurality of second openings in the upper surface 212 of the keycap 210 that are contoured in the second symbol 204, such as a shape of a second alphanumeric character that may be different than the first alphanumeric character. In some implementations, the first symbol 202 and the second symbol 204 may overlap on the upper surface 212 of the keycap 210. In some other implementations, the first symbol 202 and the second symbol 204 may substantially overlap on the upper surface 212 of the keycap 210, and a display area of the overlapping first and second shapes may occupy a substantial portion of a surface area of the upper surface 212 of the keycap 210.

In some implementations, as shown in FIG. 2C, the first passageway 220 may be arranged at a first angle in reference to the upper surface 212 and the lower surface 214 of the keycap 210, and the second passageway 224 may be arranged at a second angle in reference to the upper surface 212 and lower surface 214 of the keycap 210, wherein the second angle may be different than the first angle. The first passageway 220 may include a plurality of first microscopic passageways that are each arranged at the first angle in reference to the upper surface 212 and the lower surface 214 of the keycap 210, and the second passageway 224 may include a plurality of second microscopic passageways that are each arranged at a second angle in reference to the upper surface 212 and lower surface 214 of the keycap 210, wherein the second angle may be different than the first angle. In some implementations, as shown in FIG. 3C, the first angle may include a first angular orientation in a first direction, and the second angle may include a second angular orientation in a second direction that may be different than the first direction. In some implementations, as shown in FIG. 3C, the first angle may include the first angular orientation of greater than 0° and less than 90° from the upper surface 212 of the keycap 210, and the second angle may include the second angular orientation of greater than 90° and less than 140° from the upper surface 212 of the keycap 210.

In some implementations, one or more of the plurality of first and second passageways 220, 224 may include different angles including normal angles to achieve display of the first and second symbols 202, 204 at the upper surface 212 of the keycap 210. For instance, the plurality of first passageways 220 may include one or more passageways having an angle of, e.g., 30°, one or more passageways having an angle of, e.g., 42°, and one or more passageways having an angle of, e.g., 90°. Further, in this instance, the plurality of second passageways 224 may include one or more passageways having an angle of, e.g., 26°, one or more passageways having an angle of, e.g., 30°, and one or more passageways having an angle of, e.g., 72°. In some implementations, some of the plurality of first and second passageways 220, 224 may crisscross and/or overlap through the keycap 210.

In the illustrated implementation, the keycap 110 may be formed of an opaque material (e.g., where light does not pass through the material). For instance, in some implementations, the keycap 110 may be formed of a metal material. Specifically, in some implementations, the keycap 110 may be formed of a material that may include steel, aluminum, titanium, magnesium, copper, brass, nickel, tin, or some combination thereof. In other implementations, the keycap 110 may be formed of carbon, carbon fiber, nano-tube reinforced plastic, glass, ceramic, resin, or some combination thereof. In some implementations, the keycap 110 may be formed of a mixture of materials. In some implementations, such mixture of materials may include a metal material.

The keycap 210 may be configured to actuate the switch 230 when the keycap 210 is selected by a user. In the illustrated implementation, a user may select the keycap 210 by depressing the keycap 210 (e.g., such as depressing a key on a computer keyboard). The depressed keycap 210 may be configured to actuate the switch, which may be disposed underneath the keycap 210. The keycap assembly 200 may include a keycap return mechanism (not shown) that may be configured to return the keycap 210 to its normal state/position after being depressed by a user. The keycap return mechanism may be configured to bias the keycap 210 into a non-depressed state. The keycap return mechanism may be a scissor type structure having arms pivotally coupled to a base disposed below the keycap return mechanism, and the keycap return mechanism may be coupled, such as pivotally coupled, to the keycap 210. The keycap return mechanism may be biased to an upright or expanded configuration and may, upon the application of a force be placed in a collapsed configuration. For instance, when the keycap 210 is depressed by a user, the application of force causes the keycap return mechanism to be placed in its collapsed configuration. The removal of the force (e.g., when a user may be no longer depressing the keycap 210) causes the keycap return mechanism to return to its expanded configuration and thus, causes the keycap 210 to return to its non-depressed state. The keycap return mechanism may provide support to the keycap and helps prevent the keycap from tilting.

In the illustrated implementation, the upper surface 212 of the keycap 210 may have a width W. In some implementations, the upper surface 212 forms a rectangle when viewed from the top of the keycap 210. In some implementations, the width W of the upper surface 212 of the keycap 210 may be about 8 mm. In other implementations, the width W of the upper surface 212 of the keycap 210 may be less than 8 mm. In yet further implementations, the width W of the upper surface 212 of the keycap 210 may be greater than 8 mm. For example in some implementations, the width W of the upper surface may be between about 8 mm and 20 mm.

In the illustrated implementation, the upper surface 212 of the keycap 210 may have a length L. In some implementations, the length L of the upper surface 212 of the keycap 210 may be about 8 mm. In other implementations, the length L of the upper surface 212 of the keycap 210 may be less than 8 mm. In yet further implementations, the length L of the upper surface 212 of the keycap 210 may be greater than 8 mm. For instance, in some implementations, the length L of the upper surface 212 of the keycap 210 may be between 8 mm and 20 mm or 8 mm and 110 mm.

In the illustrated implementation, the side surface 216 of the keycap 210 may have a height H. In some implementations, the height of the side surface 216 of the keycap 210 may be about 0.5 mm. In other implementations, the height H of the side surface 216 of the keycap 210 may be less than 0.5 mm (e.g., such as between 0.2 mm and 0.5 mm). In yet further implementations, the height H of the side surface 216 of the keycap 210 may be greater than 0.5 mm.

The switch 230 may be any type of mechanical or electrical switch that may be configured to communicate with a display or other device. In the illustrated implementation, the switch 230 may be an electrical switch. When such a switch 230 may be actuated or activated, a metal contact (not illustrated) of the switch contacts and completes an electrical circuit (not illustrated) to communicate to the display or other device that the switch 230 may have been actuated.

The light sources 232, 234 may be configured to generate light and emit light through the passageways 220, 224, respectively, defined by the keycap 210. The light sources 232, 234 may be disposed such that the keycap 210 may be disposed between the user and the light sources 232, 234. The light sources 232, 234 may be disposed proximate the lower surface 214 of the keycap 210. The light sources 232, 234 may be disposed such that the lower surface 214 of the keycap 210 may be disposed between the light sources 232, 234 and the upper surface 212 of the keycap 210.

In some implementations, the light sources 232, 234 may be configured as back lights to respectively emit light through the passageways 220, 224 of the keycap 210, and as such, the keycap 210 may be backlit. For instance, light from the first light source 232 may be emitted through the first passageway 220 and out of the first opening 218 defined by the upper surface 212 of the keycap 210, and the contoured shape of the first opening 218 defined by the upper surface 212 of the keycap 210 will be illuminated to the user. In this instance, the first symbol 202 (e.g., a first character, such as the letter "A") may be illuminated to the user. In another instance, light from the second light source 234 may be emitted through the second passageway 224 and out of the second opening 222 defined by the upper surface 212 of the keycap 210, and the contoured shape of the second opening 222 defined by the upper surface 212 of the keycap 210 will be illuminated to the user. In this instance, the second symbol 204 (e.g., a second character, such as an international letter) may be illuminated to the user.

In some implementations, the light sources 232, 234 may be any device that generates or emits light. In the illustrated implementation, the light sources 232, 234 may be light emitting diodes (LEDs). In another implementation, the light sources 232, 234 may be light guide films.

Figure 3A:
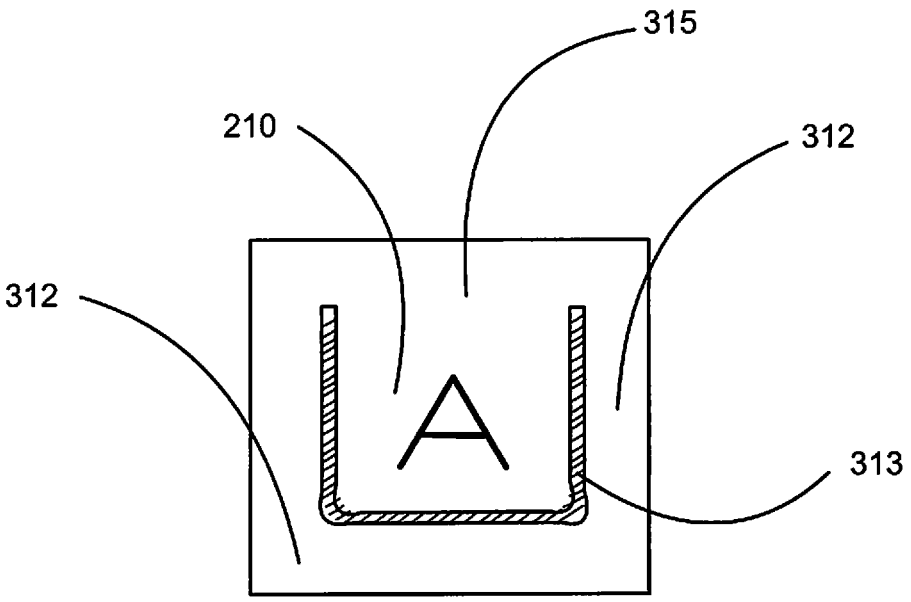
FIGS. 3A-3B are diagrams of various views of a portion of a keyboard and a keycap assembly, in accordance with aspects of the disclosure.
Figure 3B:
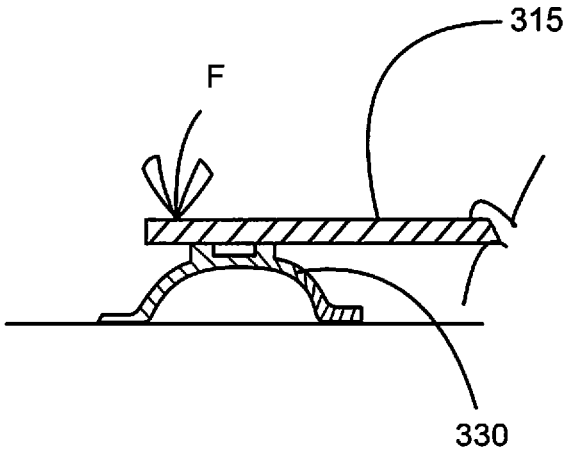

FIG. 3A is a top view of a portion of a keyboard and a keycap assembly, and FIG. 3B is a cross-sectional view of the portion of the keyboard and the keycap assembly of FIG. 3A, in accordance with aspects of the disclosure. As shown in FIGS. 3A-3B, the keycap 210 may be a cantilever keycap. For instance, in the illustrated implementation, the keycap 210 may be unitarily formed or integral with the material that forms an upper surface 312 of a keyboard.

The material that forms the upper surface 312 of the keyboard may define an opening 313. The opening 313 may define the keycap 210. In the illustrated implementation, the opening 313 may be generally "U" shaped and surrounds or may define threes sides of the keycap 210. In other implementations, the opening 313 may be of a different shape and surrounds more or less of the keycap 210.

The keycap 210 may include a flexible or bendable portion 315 that may be configured to flex or bend when a force in the direction of F, such as a user depressing the keycap 210, may be applied to the keycap 210. Accordingly, the keycap 210 may be configured to actuate a switch 330 of the keyboard when a force in the direction of F is applied to the keycap 210.

The flexible or bendable portion 315 of the keycap 210 biases the keycap 210 to its non-depressed state. Accordingly, the keycap 210 returns to its non-depressed state when the force may be removed from the keycap 210.

Figure 4A:
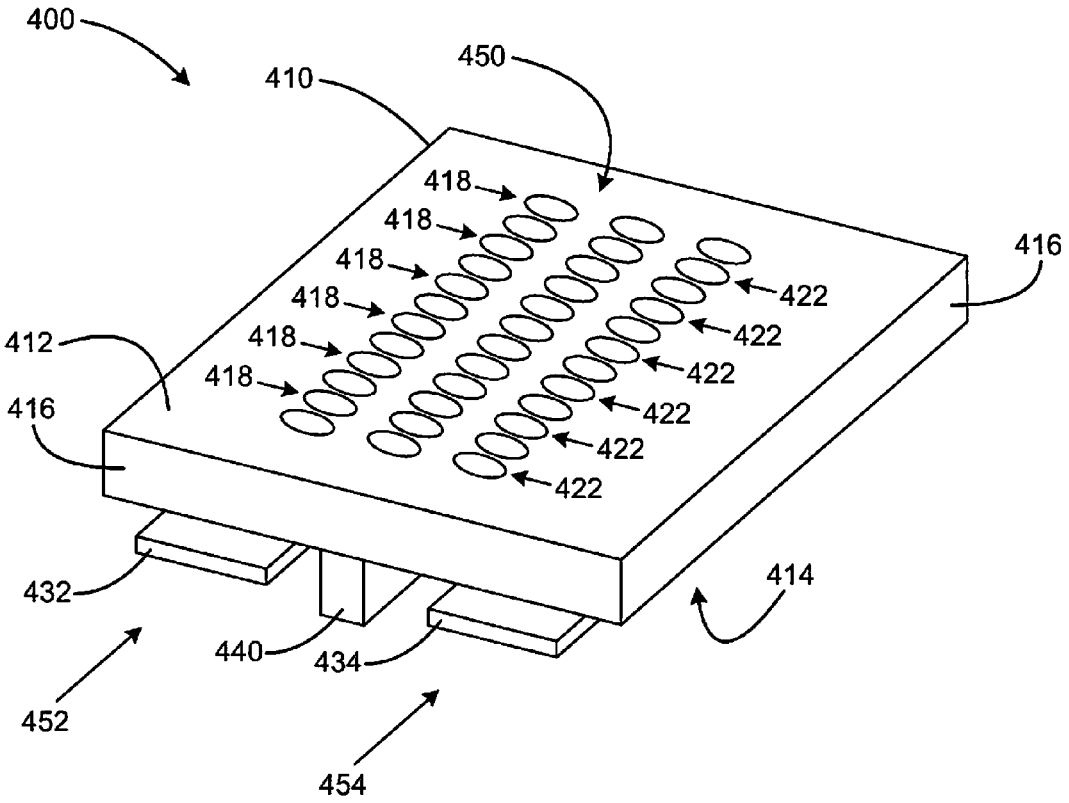
Figure 4B:
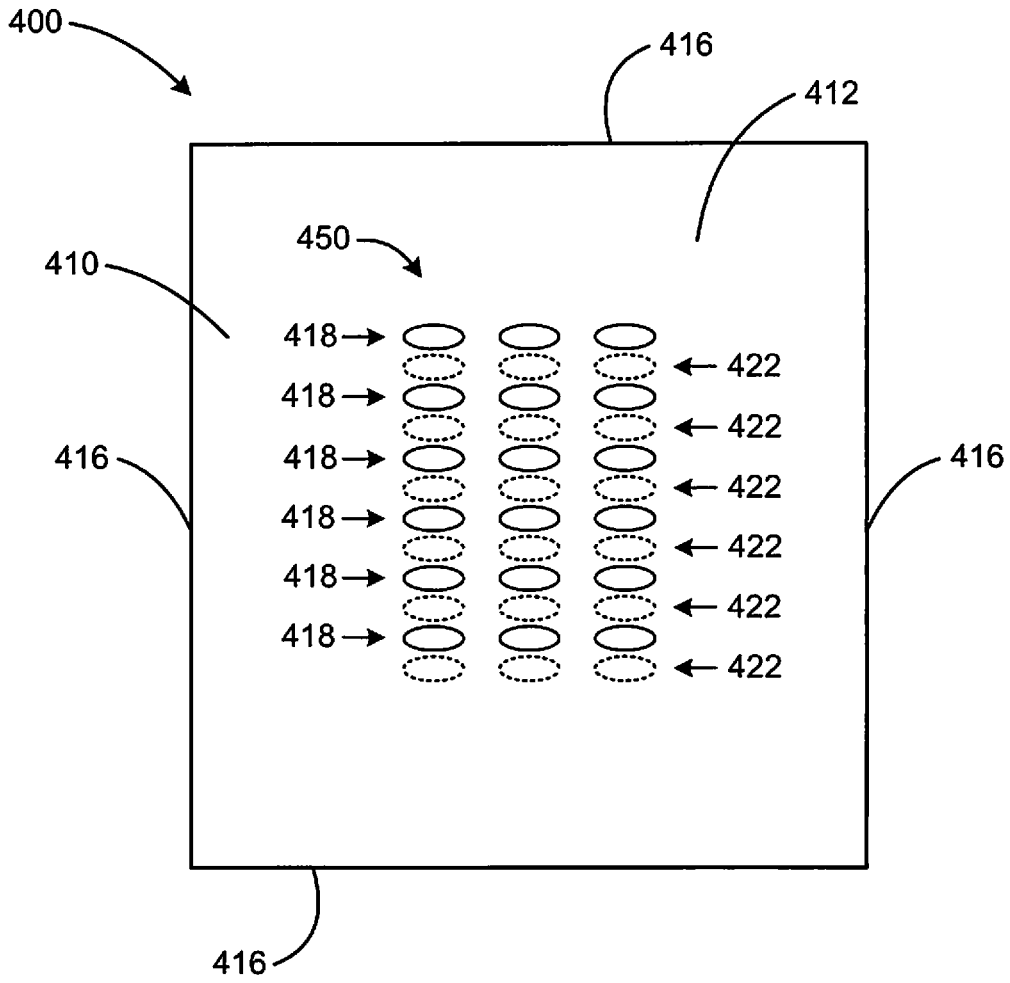
Figures 1, 4C:
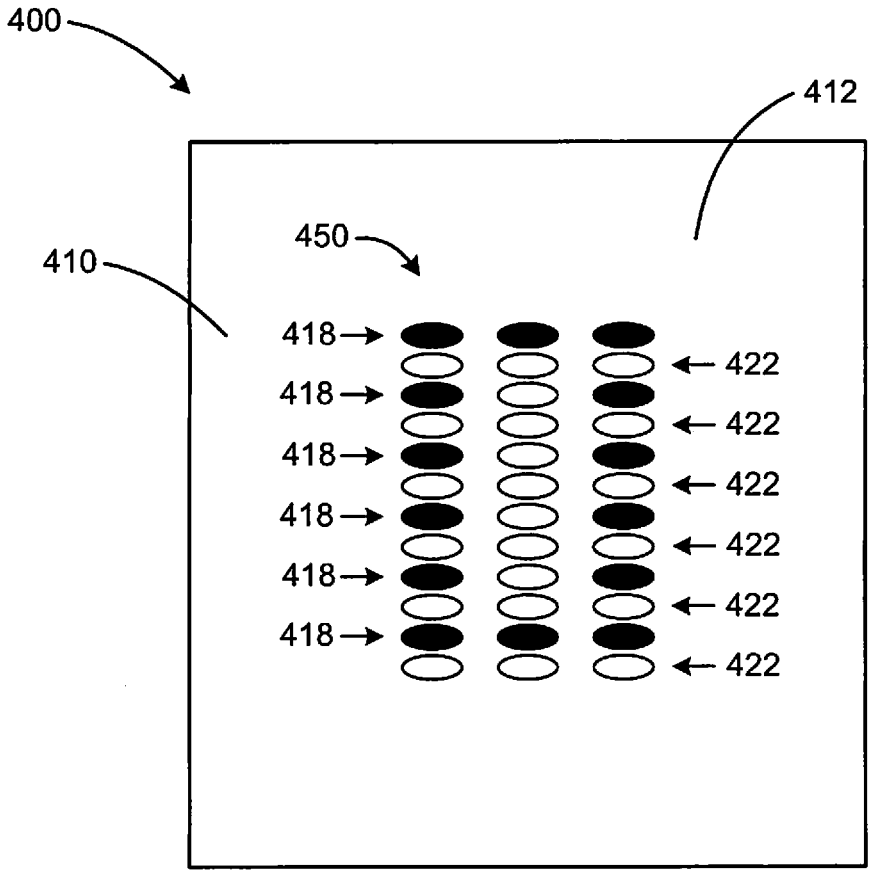
Figures 2, 4C:
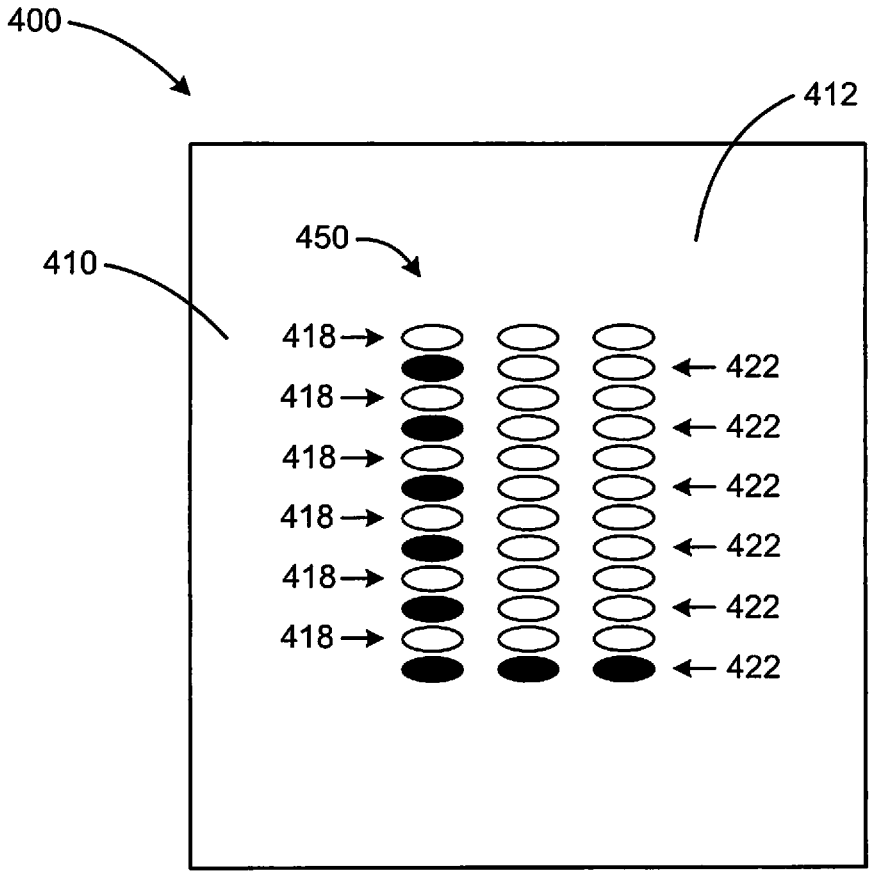

FIGS. 4A-4C are diagrams of another example keycap assembly, in accordance with aspects of the disclosure.

FIG. 4A is a diagram of another example keycap assembly 400, in accordance with aspects of the disclosure. The keycap assembly 400 may include a keycap 410, light sources 432, 434, and a partition 440. The keycap assembly 400 may be incorporated within an input of an electronic device. The keycap assembly 400 may be included in a keyboard or other type of input device. In some implementations, a keyboard, such as a computer keyboard, may include a plurality of keycaps and keycap assemblies. In some implementations, the keycap 410 may include at least one keycap of one or more keycaps associated with a keyboard of a computing device.

The keycap 410 may include a first surface 412, a second surface 414, and side surfaces 416. The first surface 412 may define a plurality of openings in a grid 450 having a grid pattern including a plurality of first openings 418 arranged in rows and a plurality of second openings 422 arranged in rows, and the second surface 414 may define a plurality of openings (not shown) including a plurality of first openings opposite the first openings 418 and a plurality of second openings opposite the second openings 422. As shown in FIG. 4A, the rows of first and second openings 418, 422 alternate (every other row) along columns from top to bottom of the grid pattern of the grid 450. As further shown in FIG. 4B, the rows of first openings 418 (shown with solid lines) alternate (every other row, starting with a first row) along the columns from top to bottom of the grid pattern of the grid 450. As further shown in FIG. 4B, the rows of second openings 422 (shown with dashed lines) alternate (every other row, starting with a second row) along the columns from top to bottom of the grid pattern of the grid 450. FIGS. 4A-4B represent one implementation of a type of layout for the openings 418, 422 of the grid pattern of the grid 450, and any useable type of layout for the openings 418, 422 of the grid pattern of the grid 450 may be implemented. In some implementations, the keycap 410 may have a generally rectangular shape (e.g., when viewed from a position above the keycap). For instance, in some implementations, the upper surface 412 may have a rectangular or square shape. The grid 450 may be referred to as a base grid that may be used to create multiple symbols or characters based on the grid pattern. The grid 450 may be referred to as a symmetric character keycap grid.

The keycap 410 may define a plurality of passageways extending through the keycap 410 including a plurality of first passageways extending from the first openings 418 through the keycap 410 to openings in the second surface 414 and a plurality of second passageways extending from the second openings 422 through the keycap 410 to openings in the second surface 414. In some implementations, the keycap 410 may define the first passageways extending through the keycap 410 between the first opening 418 in the first surface 412 and corresponding first openings in the second surface 414. The keycap 410 may define the second passageways extending through the keycap 410 between the second openings 422 in the first surface 412 and corresponding second openings in the second surface 414. The keycap 410 may include a wall or member that is formed to define a structure of the keycap 410 and further define the first surface 412 and the second surface 414. The first passageways 420 are separate from the second passageways 424.

In some implementations, the first passageways may be arranged at a first angle toward a first light source 432 in reference to the first openings 418 defined by the first surface 412 of the keycap 410, and the second passageways may be arranged at a second angle toward a second light source 434 in reference to the second openings 422 defined by the first surface 412 of the keycap 410. The second angle may be different than the first angle. In some implementations, the first passageways may include first microscopic passageways that are each arranged at the first angle, and the second passageways may include second microscopic passageways that are each arranged at the second angle. In some implementations, the first angle may include a first angular orientation in a first direction, and the second angle may include a second angular orientation in a second direction that is different than the first direction. In some implementations, the first angle may include the first angular orientation of greater than 0° and less than 90° from the first surface 412 of the keycap 410, and the second angle may include the second angular orientation of greater than 90° and less than 180° from the first surface 412 of the keycap 410.

In some implementations, the first passageways may be arranged at the first angle, and the second passageways may be arranged at the second angle that is different than the first angle, wherein the first and second passageways may be positioned adjacent to each other and/or occupy a same area defined by the grid pattern of the grid 450 of the keycap 410. The first and second passageways may include microscopic passageways, and the openings 418, 422 may include microscopic openings. In some implementations, one or more of the plurality of first and second passageways may include different angles including normal angles to achieve display of first and second shapes or symbols at the first surface 412 of the keycap 410. For instance, the plurality of first passageways 420 may include one or more passageways having an angle of, e.g., 38°, one or more passageways having an angle of, e.g., 53°, and one or more passageways having an angle of, e.g., 90°. Further, in this instance, the plurality of second passageways 424 may include one or more passageways having an angle of, e.g., 44°, one or more passageways having an angle of, e.g., 90°, and one or more passageways having an angle of, e.g., 60°. In some implementations, some of the plurality of first and second passageways may criss-cross and/or overlap through the keycap 410.

The first light source 432 may be configured to emit a first color of light through the keycap 410 by creating a first path of light through the first passageways and out of the first openings 418 to illuminate the first openings 418 to a viewer. The second light source 434 may be configured to emit a second color of light (same as or different from the first color of light) through the keycap 410 by creating a second path of light through the second passageways and out of the second openings 422 to illuminate the second openings 422 to a viewer. In various implementations, the first and second colors of light may be of a same color or of a different color. As such, the first color of light may be a same color of light as the second color of light, or the first color of light may be a different color of light than the second color of light. For instance, the first color of light may be an orange color of light, and the second color of light may be an orange color of light. In another instance, the first color of light may be a green color of light, and the second color of light may be a red color of light. However, the color or colors of light may be any useable color of light in the visible spectrum, such as blue, yellow, purple, or white light, or some other useable color. In some implementations, the first light source 432 may include a first light emitting diode (LED) that is configured to emit a first color of light, and the second light source 434 may include a second light emitting diode (LED) that is configured to emit a second color of light that is different than the first color of light.

The first light source 432 may be configured to emit a first color of light and create a first path of light through the first passageway 420 of the keycap 410. The second light source 434 may be configured to emit a second color of light and create a second path of light through the second passageway 424 of the keycap 410. In an implementation, the first color of light of the first path of light may be a same color of light as the second color of light of the second path of light. In another implementation, the first color of light of the first path of light may be a different color of light than the second color of light of the second path of light.

The keycap assembly 400 may include the partition 440 that is positioned adjacent (and/or coupled to) the second surface 414 of the keycap 410. The partition 440 may be interposed between a first position 452 of the first light source 432 and a second position 454 of the second light source 434. The first position 452 may refer to a first side of the keycap 410 that is illuminated by the first light source 432, and the second position 454 may refer to a second side of the keycap 410 that is illuminated by the second light source 434. The partition 440 may be configured to separate the first underside openings of the first passageways corresponding to the first openings 418 of the keycap 410 from the second underside openings of the second passageways corresponding to the second openings 422 of the keycap 410. The partition 440 may be one of a plurality of partitions.

In some implementations, the first passageways may include a plurality of first microscopic passageways extending through the keycap 410 between the first openings 418 in the first surface 412 of the keycap 410 and first corresponding openings in the second surface 414 of the keycap 410, and the second passageways may include a plurality of second microscopic passageways extending through the keycap 410 between the second openings 422 in the first surface 412 of the keycap 410 and second corresponding openings in the second surface 414 of the keycap 410. In some implementations, each of the openings may each include microscopic openings associated with microscopic passageways.

In an implementation, as shown in FIG. 4C-1, some of the first openings 418 of the grid pattern of the grid 450 may be illuminated and some of the first openings 418 may be blocked from illuminating to display a first symbol or character, such as the letter "0", on the first surface 412 of the keycap 410 when the first light source 432 emits light. In this implementation, the second light source 434 is not illuminated, and therefore, the second openings 422 are not illuminated.

In an implementation, as shown in FIG. 4C-2, some of the second openings 422 of the grid pattern of the grid 450 may be illuminated and some of the second openings 422 may be blocked from illuminating to display a second symbol or character, such as the letter "L", on the first surface 412 of the keycap 410 when the second light source 434 emits light. In this implementation, the first light source 432 is not illuminated, and therefore, the first openings 412 are not illuminated.

Accordingly, in some implementations, as shown in FIGS. 4C-1 and 4C-2, a same keycap 410 may be used to display two different characters on a same grid pattern of the grid 450 at two different times depending on which light source 432, 434 is activated to illuminate the openings 418, 422, respectively.

Figure 5:
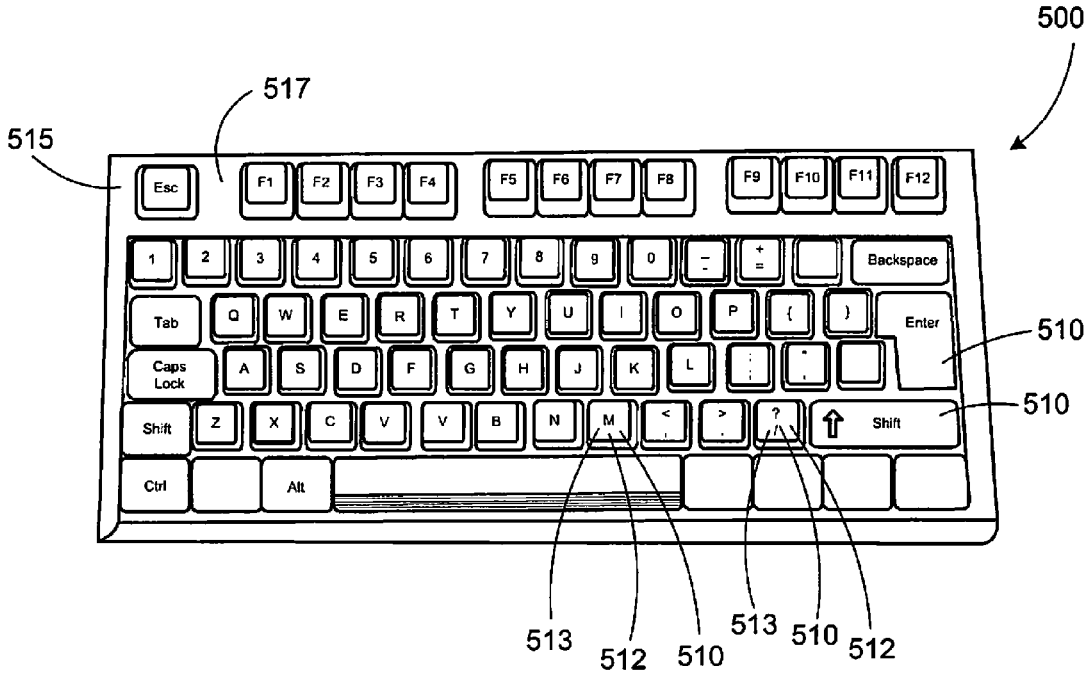
FIG. 5 is a top view of a keyboard, in accordance with aspects of the disclosure.

FIG. 5 is a top view of a keyboard 500, in accordance with aspects of the disclosure. The keyboard 500 may be coupled to and communicate with a computer or any other device. The keyboard 500 may include a plurality of keycaps 510. Each of the keycaps 510 may be configured to actuate a different switch (not illustrated). In the illustrated implementation, the keycaps 510 may include upper surfaces 512 that may define openings 513 that form symbols. Further, the keyboard 500 may include a housing 515 having one or more structural members. In the illustrated implementation, the housing 515 may include upper surfaces 517 that may define openings that form symbols, similar to the symbols formed in the keycaps 510.

In some implementations, a computing device may be configured to interface with the keyboard 500 and include memory for storing instructions and include at least one processor for executing the stored instructions. The instructions may be configured to cause first and/or second light sources to be illuminated in response to various inputs (e.g., via user input, the user may selectively illuminate at least one of the first and second light sources to display a particular character set displayed by the keycaps 510. Further, in some implementations, messages including error messages may be displayed to the user via a housing of the keyboard 500 that may define openings forming symbols, similar to the symbols formed in the keycaps 510.

Figure 6:
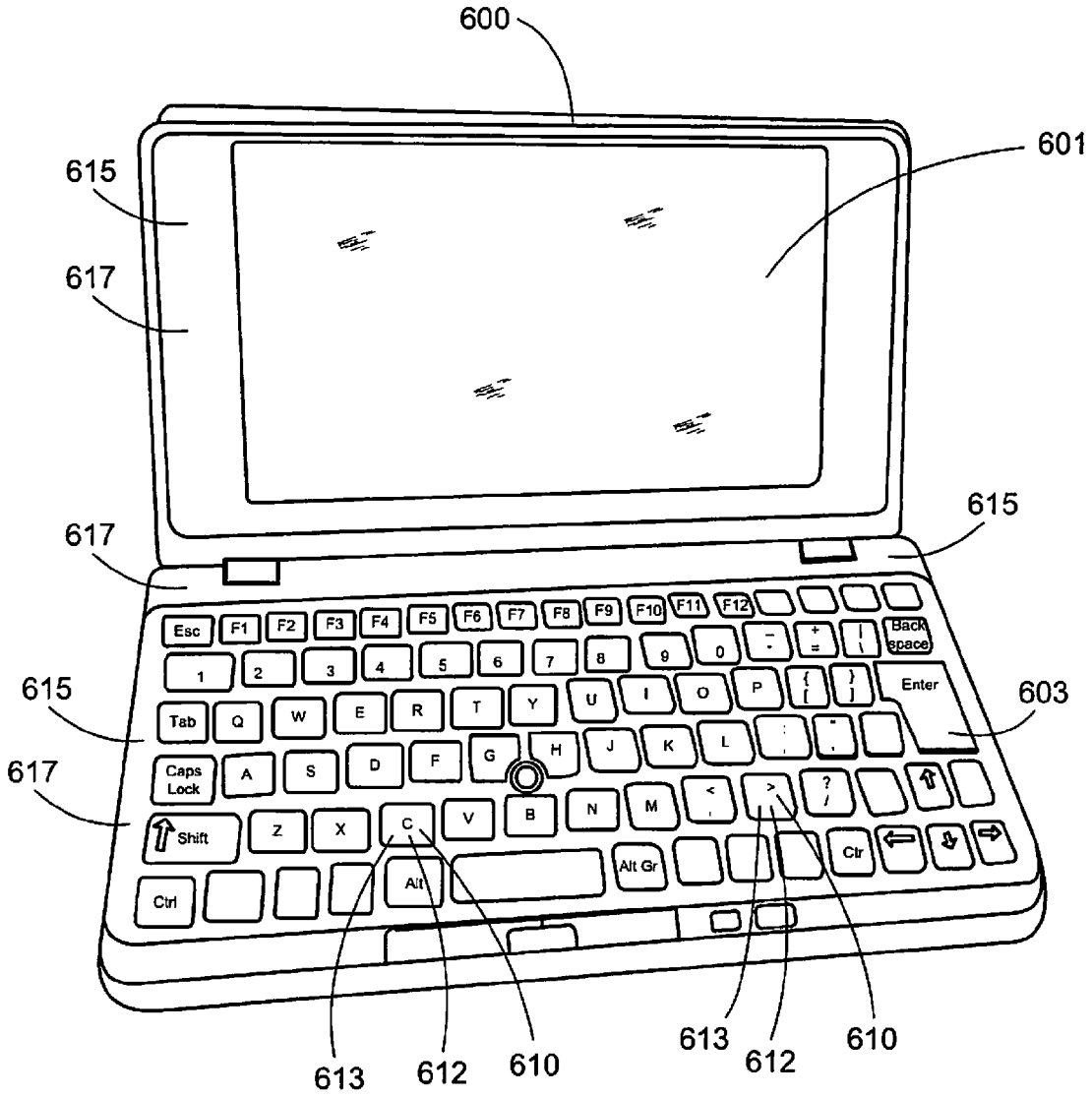
FIG. 6 is a perspective view of a laptop computer, in accordance with aspects of the disclosure.

FIG. 6 is a perspective view of a laptop computer 600, in accordance with aspects of the disclosure. The laptop computer 600 may include a keyboard 603 and a display or monitor 601. The keyboard 603 may include a plurality of keycaps 610. Each of the keycaps 610 may be configured to actuate a different switch (not illustrated). In the illustrated implementation, the keycaps 610 may include upper surfaces 612 that may define openings 613 that form symbols. Further, the keyboard 603 may include a housing 615 having one or more structural members. In the illustrated implementation, the housing 615 may include upper surfaces 617 that may define openings that form symbols, similar to the symbols formed in the keycaps 610.

In some implementations, the laptop computer 600 includes the keyboard 603 and memory for storing instructions and at least one processor for executing the stored instructions. The instructions may be configured to cause first and/or second light sources to be illuminated in response to various inputs (e.g., via user input, the user may selectively illuminate at least one of the first and second light sources to display a particular character set displayed by the keycaps 610). Further, in some implementations, messages including error messages may be displayed to the user via the housing 615 that may define openings forming symbols, similar to the symbols formed in the keycaps 610.

In various implementations, the laptop computer 600 may include any type of computing device including notebook computer, desktop computers, mobile phones, etc. Elements of the laptop computer 600 or computing device may include at least one processor for executing instructions and memory (e.g., one or more memory devices) for storing instructions and data. Generally, computing devices may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices, magnetic disks, e.g., internal hard disks or removable disks, magneto-optical disks; and CD-ROM and DVD-ROM disks. The at least one processor and memory may be supplemented by, or incorporated in special purpose logic circuitry.

To provide for user interaction, implementations may be implemented on a computer having a display or display device, e.g., a liquid crystal display (LCD) monitor, for displaying information to the user and a keyboard and a pointing device, e.g., a mouse or a trackball, by which the user may provide input to the computer. Other types of devices may be used to provide for interaction with a user as well; for example, feedback provided to the user may be any form of sensory feedback, e.g., visual feedback, auditory feedback, or tactile feedback, and input from the user may be received in any form, including acoustic, speech, or tactile input.

Figure 7:
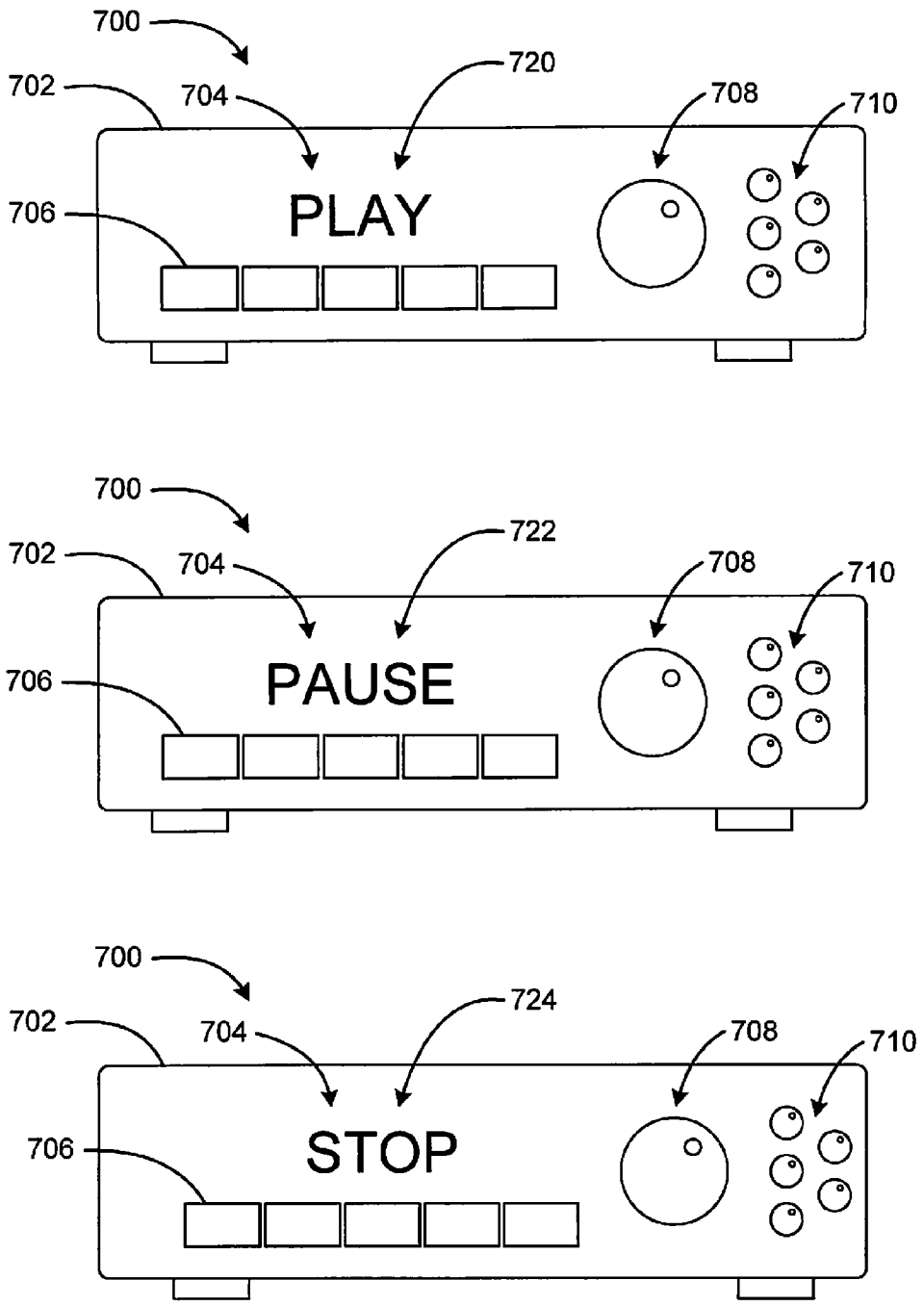
FIG. 7 is a front view of various examples of a home audio equipment, in accordance with aspects of the disclosure.

FIG. 7 is a front view of various examples of a home audio equipment 700, in accordance with aspects of the disclosure. In some implementations, the home audio equipment 700 may include a housing 702 with a display surface 704, one or more selector caps 706, a volume rotary dial 708, and one or more audio trim dials 710. Each of the selector caps 706 may be configured to actuate a different switch (not illustrated) for performing various audio related functions and/or operations. In the illustrated implementation, the selector caps 706 may include upper surfaces that may define openings that form symbols, similar to the symbols formed in the keycaps as described herein. Further, the home audio equipment 700 may include the housing 702 having one or more structural members.

In some implementations, the housing 702 may include outer surfaces that may define openings that form symbols, similar to the symbols formed in the keycaps as described herein. Further, the display surface 704 may also define openings that form symbols, similar to the symbols formed in the keycaps and the selector caps 706 as described herein. In the some implementations, the housing 702 may include outer surfaces in a same area as the display surface 704 that may define openings that form symbols to display messages to a user upon actuation of the selector caps 706, similar to the symbols formed in the keycaps as described herein. In various implementations, the display area 704 may display a message symbol when the selector caps 706 are actuated by a user pressing the various selector caps 706, wherein the displayed message symbol may include play 720, pause 722, and/or stop 724. However, any message symbol may be displayed to the user, including displaying a message symbol for a specific channel value, displaying a message symbol for a current volume value actuated by the volume rotary dial 708, displaying a message symbol for each of a current audio trim value actuated by the one or more audio trim dials 710, etc.

In some implementations, the home audio equipment 700 may include memory for storing instructions and at least one processor for executing the stored instructions. The instructions may be configured to cause one or more light sources to be illuminated for the display area 704 and/or the one or more selector caps 706 in response to various user selected input (e.g., via user input, the user may selectively illuminate at least one of light source to display a particular character set displayed via the display area 704 and/or the selector caps 706). Further, in some implementations, messages including error messages may be displayed to the user via the display area 704.

In various implementations, the home audio equipment 700 may include any type of audio device including a DVD player, a CD player, a home entertainment receiver, a television, satellite receiver, cable box receiver, etc. Elements of the home audio equipment 700 may include at least one processor for executing instructions and memory (e.g., one or more memory devices) for storing instructions and data. Generally, audio equipment may include, or be operatively coupled to receive data from or transfer data to, or both, one or more various data storage devices for storing data, e.g., magnetic, magneto-optical disks, optical disks, or special purpose logic circuitry. Other types of devices may be used to provide for interaction with a user as well; for example, feedback provided to the user may be any form of sensory feedback, e.g., visual feedback, auditory feedback, or tactile feedback; and input from the user may be received in any form, including acoustic, speech, or tactile input.

In various example implementations, aspects of the disclosure may be used generally and are thus not limited to the specific implementations described in this specification (e.g., computers, audio equipment, etc.). As such, various aspects of the disclosure may be applied to and/or implemented in any type of system and/or device including any surface thereof that may benefit from using angled laser etched holes (or openings) to display multiple characters and/or segments thereof in one or more spots or positions using multiple light sources, in a manner as described herein.

Figure 8:
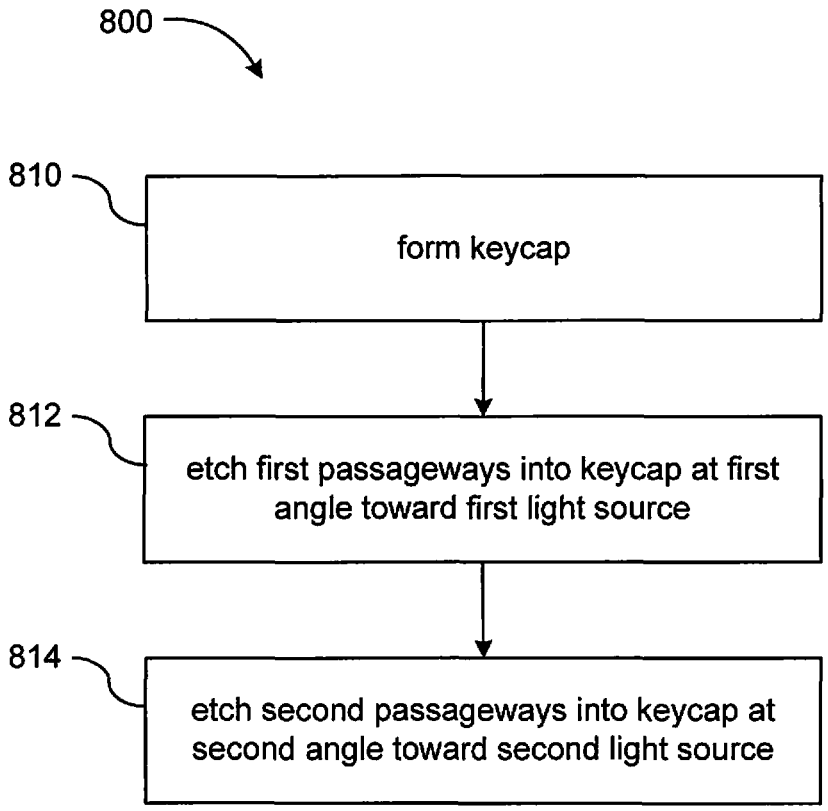
FIG. 8 is a flow chart that illustrates an example method for forming a keycap, in accordance with aspects of the disclosure.

FIG. 8 is a flow chart that illustrates an example method 800 for forming a keycap, in accordance with aspects of the disclosure. At step 810, the keycap may be formed. The keycap may be formed of various materials, such as, e.g., an opaque material, such as, e.g., a metal material, a plastic material, or some combination thereof. The keycap may be formed by molding or machining or any other known method for forming objects of a metal material.

At step 812, one or more first passageways may be etched into the keycap at a first angle toward a first light source. The keycap may be etched for displaying a first symbol or character using the keycap. For instance, the keycap may be etched to include a first symbol, such as a letter, a number, a character, or international type symbols.

At step 814, one or more second passageways may be etched into the keycap at a second angle toward a second light source. The keycap may be etched for displaying a second symbol or character using the keycap. For instance, the keycap may be etched to include a second symbol, such as a letter, a number, a character, or international type symbols.

In various implementations, the first and second passageways may be formed through the keycap. The passageways may extend from an upper surface of the keycap to a lower surface of the keycap. The passageways may be formed by drilling, piercing, and/or perforating through the keycap. The passageway may be micro-drilled, micro-pierced, and/or micro-perforated using a laser. The passageways may be formed using another known method or tool.

In various implementations, the size of the openings and size of the passageways and the various angles at which the openings and passageways are formed may be controlled with laser drilling, piercing, perforating, etc. For instance, the laser may be tuned to control the size of the openings and size of the passageways and the various angles at which the openings and passageways are formed.

In some implementations, a plurality of first and second passageways may be formed through the keycap. For instance, a plurality of microscopic passageways may be formed through the keycap. The openings defined by an upper surface of the keycap may collectively form first and second symbols, such as multiple alphanumeric symbols and/or characters, and/or multiple international type symbols.

For instance, an etching process may be used to form the passageway or passageways of the keycap. To etch the keycap a typical etching process may be used, including micro-drilling. A metal keycap may be covered with a resist or ground material that may be resistant to acid. The resist or ground material may be then removed from desired portions of the keycap. The keycap may be then exposed to an acid material that dissolves the metal material of the keycap that may be not covered with the resist. In this implementation, the acid material may be used to form the openings and passageways of the keycap.

In some implementations, a sheet of keycaps may be formed, stamped out, and then etched individually. In other implementations, a sheet of material may be etched with the characters of many keycaps and the keycaps are then stamped from the etched material.

In some implementations, the method may include disposing a translucent/transparent material or semi-translucent/transparent material into the passageway defined by the keycap. The translucent/transparent material may be a clear plastic. The method may include treating a surface of a metal material of the keycap to allow a plastic material to adhere to the metal surface and then adhering the plastic material to the metal material. The translucent/transparent material may be nano-injected into the passageway defined by the passageways of the keycap.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein may include various combinations and/or sub-combinations of the functions, components and/or features of the different implementations described.

What is claimed is:

1. A computing device comprising:

at least one keycap having a wall with a first surface and a second surface, the at least one keycap including a plurality of first microscopic passageways extending between a plurality of first openings in the first surface and a plurality of first openings in the second surface, the at least one keycap including a plurality of second microscopic passageways extending between a plurality of second openings in the first surface and a plurality of second openings in the second surface;

a first light source positioned at a first location adjacent the second surface of the at least one keycap, the first light source and the plurality of first and second microscopic passageways arranged to allow light from the first light source to pass through the wall via the plurality of first microscopic passageways and inhibit light from the first light source from passing through the wall via the plurality of second microscopic passageways; and a second light source positioned at a second location adjacent the second surface of the at least one keycap, the second light source and the plurality of first and second microscopic passageways arranged to allow light from the second light source to pass through the wall via the plurality of second microscopic passageways and inhibit light from the second light source from passing through the wall via the plurality of first microscopic passageways.

2. The computing device of claim 1, wherein the first surface includes an upper surface of the at least one keycap, and wherein the second surface includes a lower surface of the at least one keycap.

3. The computing device of claim 1, wherein the plurality of first openings in the first surface of the at least one keycap are contoured in a first shape, and the plurality of second openings in the first surface of the at least one keycap are contoured in a second shape that is different than the first shape.

4. The computing device of claim 1, wherein the plurality of first openings in the first surface of the at least one keycap are contoured in a first shape of a first alphanumeric character, and the plurality of second openings in the first surface of the at least one keycap are contoured in a second shape of a second alphanumeric character that is different than the first alphanumeric character.

5. The computing device of claim 4, wherein the first shape and the second shape overlap on the first surface of the at least one keycap.

6. The computing device of claim 4, wherein the first shape and the second shape substantially overlap on the first surface of the at least one keycap, and a display area of the overlapping first and second shapes occupies a substantial portion of a surface area of the first surface of the at least one keycap.

7. The computing device of claim 1, wherein each of the openings include a microscopic illumination hole.

8. The computing device of claim 1, further comprising:

a partition positioned adjacent the second surface of the at least one keycap, the partition interposed between the first position of the first light source and the second position of the second light source, the partition separating the plurality of first openings in the second surface of the at least one keycap for the plurality of first microscopic passageways from the plurality of second openings in the second surface of the at least one keycap for the plurality of second microscopic passageways.

9. The computing device of claim 1, wherein the plurality of first microscopic passageways are each arranged at a first angle in reference to the first surface and the second surface of the at least one keycap, and the plurality of second microscopic passageways are each arranged at a second angle in reference to the first surface and second surface of the at least one keycap, the second angle is different than the first angle.

10. The computing device of claim 9, wherein the first angle includes a first angular orientation in a first direction, and the second angle includes a second angular orientation in a second direction that is different than the first direction.

11. The computing device of claim 9, wherein the first angular orientation is greater than 0° and less than 90° from the first surface of the at least one keycap, and the second angular orientation is greater than 90° and less than 180° from the first surface of the at least one keycap.

12. The computing device of claim 1, wherein the first light source is configured to emit a first color of light, and the second light source is configured to emit a second color of light that is different than the first color of light.

13. The computing device of claim 1, wherein the first light source includes a first light emitting diode that is configured to emit a first color of light, and the second light source includes a second light emitting diode that is configured to emit a second color of light that is different than the first color of light.

14. The computing device of claim 1, further comprising:

a keyboard including the at least one keycap;

memory configured to store instructions; and at least one processor configured to execute the instructions to:

cause the first light source to emit a first color of light in response to a first input via a switch activated by the at least one keycap when actuated by a user, and cause the second light source to emit a second color of light different than the first color of light in response to a second input via the switch activated by the at least one keycap when actuated by the user.

15. An apparatus comprising:

a feature including a material having an upper surface and a lower surface;

a first passageway extending between a first upper opening in the upper surface of the feature and a first lower opening in the lower surface of the feature;

a second passageway extending between a second upper opening in the upper surface of the feature and a second lower opening in the lower surface of the feature;

a first light source positioned underneath the feature proximate to the lower surface of the feature that provides light of a first color to pass through the feature via the first passageway;

a second light source positioned underneath the feature proximate to the lower surface of the feature that provides light of a second color different than the first color to pass through the feature via the second passageway; and a partition coupled to the lower surface of the feature, the partition interposed between the first light source and the second light source, the partition separating the first lower opening of the first passageway from the second lower opening of the second passageway.

16. The apparatus of claim 15, wherein:

the apparatus includes a computing device, the feature includes a keycap, the upper surface of the feature includes an upper surface of the keycap, and the lower surface of the feature includes a lower surface of the keycap.

17. The apparatus of claim 15, wherein:

the apparatus includes a computing device, the feature includes a housing of the apparatus, the upper surface of the feature includes an outer surface of the housing, and the lower surface of the feature includes an inner surface of the housing.

18. The apparatus of claim 15, wherein:

the first upper opening and the second upper opening in the upper surface of the feature are contoured in a shape of at least one alphanumeric character, the first light source is configured to emit a first color of light, and the second light source is configured to emit a second color of light that is different than the first color of light.

19. The apparatus of claim 15, wherein:

the first passageway is arranged at a first angle in reference to the upper surface and the lower surface of the feature, the first angle including an angular orientation in a first direction, and the second passageway is arranged at a second angle in reference to the upper surface and lower surface of the feature, the second angle is different than the first angle, the second angle including an angular orientation in a second direction that is different than the first direction.

20. A keyboard of a computing device, the keyboard comprising:

a keycap having an upper surface and a lower surface, the keycap including a first microscopic passageway extending between a first upper opening in the upper surface of the keycap and a first lower opening in the lower surface of the keycap, the keycap including a second microscopic passageway extending between a second upper opening in the upper surface of the keycap and a second lower opening in the lower surface of the keycap;

a first light source positioned underneath the keycap proximate to the lower surface of the keycap that provides light of a first color to pass through the keycap via the first microscopic passageway;

a second light source positioned underneath the keycap proximate to the lower surface of the keycap that provides light of a second color different than the first color to pass through the keycap via the second microscopic passageway; and a partition interposed between the first light source and the second light source, the partition separating the first lower opening of the first microscopic passageway from the second lower opening of the second microscopic passageway.

* * * * *